US010906156B2

(12) United States Patent
Sventek et al.

(10) Patent No.: US 10,906,156 B2
(45) Date of Patent: Feb. 2, 2021

(54) FLEXIBLE ABRASIVE ROTARY TOOL

(71) Applicant: 3M INNOVATIVE PROPERTIES COMPANY, St. Paul, MN (US)

(72) Inventors: Bruce A. Sventek, Woodbury, MN (US); David G. Baird, Woodbury, MN (US); Adam J. Painter, Minneapolis, MN (US); Tammy J. Engfer, Houlton, WI (US); Dennis J. Stapleton, Roberts, WI (US)

(73) Assignee: 3M INNOVATIVE PROPERTIES COMPANY, Saint Paul, MN (US)

( * ) Notice: Subject to any disclaimer, the term of this patent is extended or adjusted under 35 U.S.C. 154(b) by 300 days.

(21) Appl. No.: 15/758,192

(22) PCT Filed: Sep. 6, 2016

(86) PCT No.: PCT/US2016/050350

§ 371 (c)(1),
(2) Date: Mar. 7, 2018

(87) PCT Pub. No.: WO2017/044403

PCT Pub. Date: Mar. 16, 2017

(65) Prior Publication Data

US 2018/0250793 A1 Sep. 6, 2018

Related U.S. Application Data

(60) Provisional application No. 62/215,646, filed on Sep. 8, 2015.

(51) Int. Cl.
*B24D 3/10* (2006.01)
*B24D 3/18* (2006.01)
(Continued)

(52) U.S. Cl.
CPC ..... *B24D 3/10* (2013.01); *B24B 5/313* (2013.01); *B24B 5/48* (2013.01); *B24B 9/065* (2013.01);
(Continued)

(58) Field of Classification Search
CPC ... B24D 3/10; B24D 3/18; B24D 3/28; B24D 11/02; B24D 1/04; B24D 13/12;
(Continued)

(56) References Cited

U.S. PATENT DOCUMENTS 3,103,029 A 9/1963 Valles
3,955,324 A 5/1976 Lindstrom
(Continued)

FOREIGN PATENT DOCUMENTS

GB 624928 6/1949
JP 2009-247789 10/2009
(Continued)

OTHER PUBLICATIONS

Extended EP Search Report, EP 16844924.7, dated Apr. 3, 2019, 7 pages.
(Continued)

*Primary Examiner* — Dung Van Nguyen
(74) *Attorney, Agent, or Firm* — Daniel J. Iden

(57) ABSTRACT

An abrasive rotary tool includes a tool shank a flexible planar section positioned opposite the tool shank. The flexible planar section forms a first abrasive external surface on a first side of the flexible planar section and a second abrasive external surface on a second side of the flexible planar section. The flexible planar section facilitates abrading, corners of a workpiece across multiple angles relative to the axis of rotation for the rotary tool through bending of the flexible planar section when the abrasive external surfaces are applied to a corner of the workpiece.

18 Claims, 6 Drawing Sheets

(51) Int. Cl.

| | |
|---|---|
| ***B24D 3/28*** | (2006.01) |
| ***B24D 11/02*** | (2006.01) |
| ***B24D 11/04*** | (2006.01) |
| ***B24D 13/12*** | (2006.01) |
| ***B24D 13/14*** | (2006.01) |
| ***B24B 5/48*** | (2006.01) |
| ***B24B 9/06*** | (2006.01) |
| ***B24B 9/10*** | (2006.01) |
| ***B24B 5/313*** | (2006.01) |

(52) U.S. Cl.
CPC ..... *B24B 9/10* (2013.01); *B24D 3/18* (2013.01); *B24D 3/28* (2013.01); *B24D 11/02* (2013.01); *B24D 11/04* (2013.01); *B24D 13/12* (2013.01); *B24D 13/142* (2013.01); *B24D 13/147* (2013.01)

(58) Field of Classification Search
CPC .... B24D 13/142; B24D 13/147; B24B 5/313; B24B 9/065; B24B 9/10
See application file for complete search history.

(56) References Cited

U.S. PATENT DOCUMENTS

| | | | | |
|---|---|---|---|---|
| 4,314,827 | A | 2/1982 | Leitheiser | |
| 4,623,364 | A | 11/1986 | Cottringer | |
| 4,744,802 | A | 5/1988 | Schwabel | |
| 4,770,671 | A | 9/1988 | Monroe | |
| 4,835,912 | A * | 6/1989 | Block | B24D 13/16 451/465 |
| 4,881,951 | A | 11/1989 | Wood | |
| 5,197,998 | A * | 3/1993 | Germain | B24D 13/08 451/533 |
| 5,405,286 | A * | 4/1995 | Welsch | B24D 13/085 451/358 |
| 5,643,068 | A * | 7/1997 | Ward, Sr. | B24D 11/008 451/526 |
| 5,851,142 | A | 12/1998 | Bullock | |
| 5,958,794 | A | 9/1999 | Bruxvoort | |
| 6,319,108 | B1 | 11/2001 | Adefris | |
| 6,551,366 | B1 | 4/2003 | D'Souza | |
| 6,595,842 | B2 * | 7/2003 | Misiura | B24D 13/16 15/230.14 |
| 2004/0058633 | A1 | 3/2004 | Deware | |
| 2010/0257685 | A1 | 10/2010 | Tuman | |
| 2012/0017937 | A1 | 1/2012 | Sabade | |
| 2012/0156972 | A1 | 6/2012 | Brown | |
| 2013/0273810 | A1 | 10/2013 | Hsu | |
| 2014/0141703 | A1 | 5/2014 | Ebert | |
| 2014/0323020 | A1 | 10/2014 | Kaul | |

FOREIGN PATENT DOCUMENTS

| | | | |
|---|---|---|---|
| JP | 2014-014905 | A | 1/2014 |
| JP | 2014-108478 | A | 6/2014 |
| WO | WO 2013-003565 | | 1/2013 |
| WO | WO 2015-042335 | | 3/2015 |
| WO | WO 2017-044404 | | 3/2017 |

OTHER PUBLICATIONS

Shitova, "Glass Edge Quality and Strength" Plenum Publishing Corporation, 1992, 2 pages.
International Search Report for PCT International Application No. PCT/US2016/050350, dated Dec. 5, 2016, 2 pages.

* cited by examiner

FLEXIBLE ABRASIVE ROTARY TOOL

CROSS REFERENCE TO RELATED APPLICATIONS

This application is a national stage filing under 35 U.S.C. 371 of PCT/US2016/050350, filed Sep. 6, 2016, which claims the benefit of U.S. Provisional Application No. 62/215,646, filed Sep. 8, 2015, the disclosure of which is incorporated by reference in its entirety herein.

TECHNICAL FIELD

The invention relates to abrasives and abrasive tools.

BACKGROUND

Handheld electronics, such as touchscreen smartphones and tablets, often include a coverglass to provide durability and optical clarity for the devices. Production of coverglass may use computer numerical control (CNC) machining for consistency of features in the coverglass and high volume production. The edge finishing of the perimeter of a coverglass as well as machined features, such as holes, in the coverglass is important for strength and cosmetic appearance.

SUMMARY

This disclosure is directed to abrasives and abrasive tools. The disclosed techniques may be of particular usefulness for surface finishing, such as edge finishing or polishing after an edge grinding step as part of a coverglass manufacturing process.

In one example, this disclosure is directed to an abrasive rotary tool including a tool shank defining an axis of rotation for the rotary tool, and an abrasive external surface formed from an abrasive material. The abrasive material comprises a resin, and a plurality of ceramic abrasive agglomerates dispersed in the resin, the ceramic abrasive agglomerates comprising individual abrasive particles dispersed in a porous ceramic matrix. At least a portion of the porous ceramic matrix comprises glassy ceramic material. The ceramic abrasive agglomerates define an agglomerate size and the individual abrasive particles define an abrasive size. A ratio of the agglomerate size to the abrasive size is no greater than 15 to 1.

In further example, this disclosure is directed to a method of finishing an edge of a partially-finished cover glass for an electronic device using the abrasive rotary tool of the preceding paragraph, the method comprising continuously the rotating abrasive rotary tool, and contacting the edge with the abrasive external surface of the continuously rotating abrasive rotary tool to abrade the edge.

In another example, this disclosure is directed to abrasive rotary tool comprising a tool shank defining an axis of rotation for the rotary tool, and a flexible planar section positioned opposite the tool shank.

The flexible planar section forms a first abrasive external surface on a first side of the flexible planar section, the first side of the flexible planar section facing generally away from the tool shank. The flexible planar section forms a second abrasive external surface on a second side of the flexible planar section, the second side of the flexible planar section facing in the general direction of the tool shank. The flexible planar section facilitates abrading, with the first abrasive external surface, a first corner adjacent to a first side of a workpiece across multiple angles relative to the axis of rotation for the rotary tool through bending of the flexible planar section when the first abrasive external surface is applied to the first corner of the workpiece. The flexible planar section facilitates abrading, with the second abrasive external surface, a second corner adjacent to a second side of the workpiece, the second side of the workpiece opposing the first side of the workpiece, across multiple angles relative to the axis of rotation for the rotary tool through bending of the flexible planar section when the second abrasive external surface is applied to the second corner of the workpiece.

The details of one or more examples of this disclosure are set forth in the accompanying drawings and the description below. Other features, objects, and advantages of this disclosure will be apparent from the description and drawings, and from the claims.

DETAILED DESCRIPTION

Diamond abrasive tools may be used to improve the surface finish of perimeter edges and feature perimeter edges of a coverglass machining process. Such diamond abrasive tools include metal bonded diamond tools, such as plated, sintered and brazed metal bonded diamond tools. Metal bonded diamond tools may provide relatively high durability and effective cutting rates, but leave micro-cracks in the glass that are stress points that can be the initiation points for breakage, significantly reducing the strength of a finished coverglass below its potential fracture resistance.

To improve the strength and/or appearance of coverglass, the edges can be polished following a grinding of machined edges, using, for example, a cerium oxide (CeO) slurry, to remove grinding and machining marks in the coverglass. However, such edge polishing can be lengthy for a coverglass, up to many hours in order to provide a desired surface finish for all edges of a coverglass. For example, polishing of a single coverglass many required steps to effectively polish all edges, including the perimeter, holes and corners. Polishing machines can be relatively large and expensive, and unique to the particular feature being polished. For this reason, production of coverglass in a manufacturing environment may include a number of parallel polishing lines, each including a number of polishing machines, in order to provide a desired production capacity of coverglass for the facility. Reducing processing time would allow an increase in the throughput of each polishing line.

In addition, polishing slurries may be inconsistent such that the polishing of a coverglass is not precisely predictable. Polishing may also cause an undesirable rounding of the corners following the relatively precise shaping provided by the grinding operations. In general, longer polishing provides an improved surface finish, but a greater rounding effect and less precision for the final dimensions of the coverglass. Reducing processing time to provide desired surface finish qualities of a coverglass may not only reduce production time, but may also provide more precise dimensional control for the production of coverglass. The abrasive compounds and tools disclosed herein may facilitate such a reduction in processing time for the production of coverglass.

Figure 1:
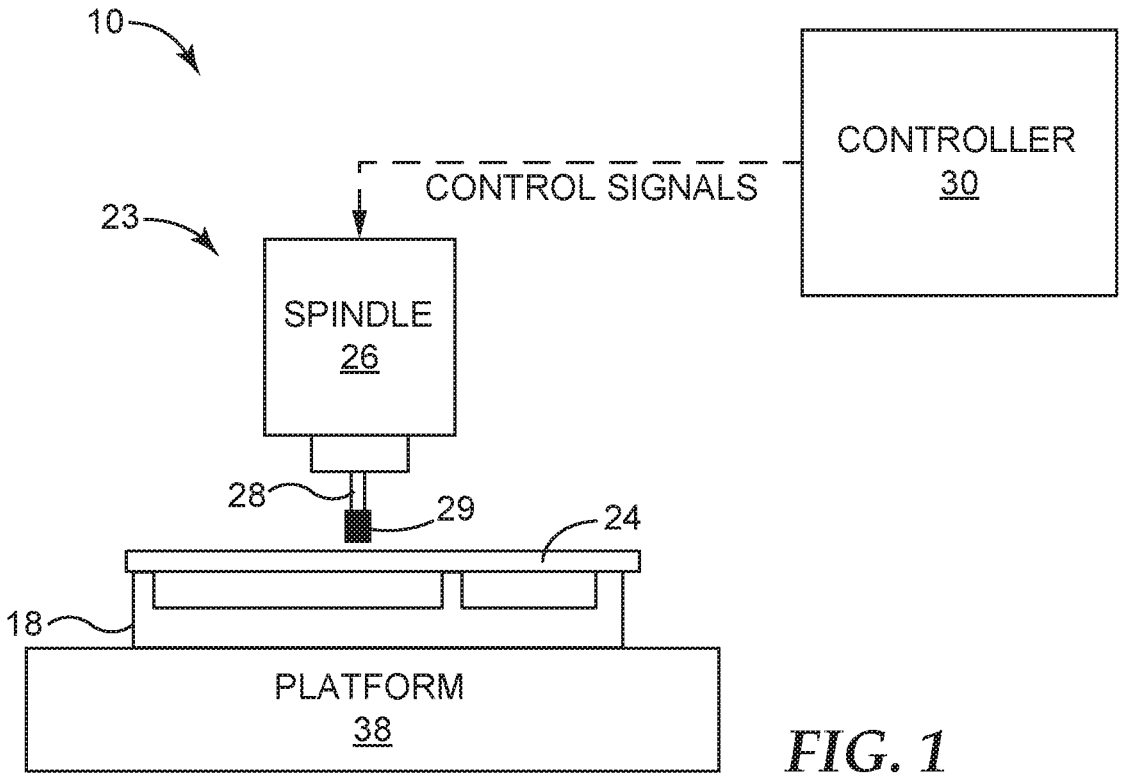
FIG. 1 illustrates a system for abrading a workpiece, such as a coverglass for an electronic device with a rotary abrasive tool.
Figure 3:
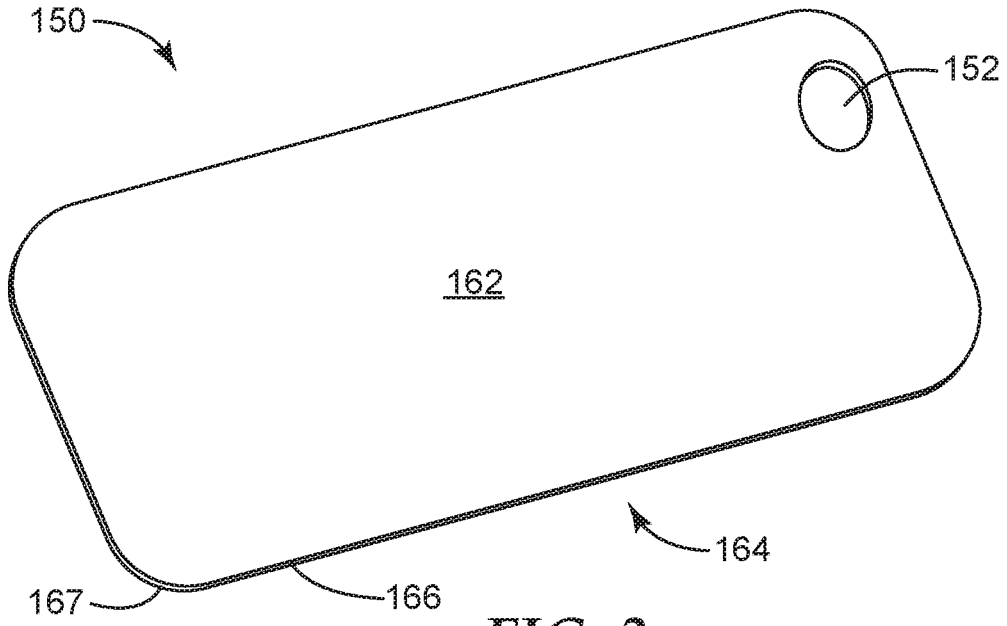
FIG. 3 illustrates a partially-finished coverglass for an electronic device.

FIG. 1 illustrates system 10, which includes rotary machine 23 and rotary machine controller 30. Controller 30 is configured to send control signals to rotary machine 23 for causing rotary machine 23 to machine, grind or abrade component 24 with rotary tool 28, which is mounted within spindle 26 of rotary machine 23. For example, component 24 may be a coverglass, such as coverglass 150 (FIG. 3). In different examples rotary tool 28, may be one of rotary tools 100, 200, 300, 400, 500 or 600 as described later in this paper. In one example, rotary machine 23 may represent a CNC machine, such as a three, four or five axis CNC machine, capable of performing routing, turning, drilling, milling, grinding, abrading, and/or other machining operations, and controller 30 may include a CNC controller that issues instructions to spindle 26 for performing machining, grinding and/or abrading of component 24 with one or more rotary tools 28. Controller 30 may include a general purpose computer running software, and such a computer may combine with a CNC controller to provide the functionality of controller 30.

Component 24 is mounted to platform 38 in a manner that facilitates precise machining of component 24 by rotary machine 23. Work holding fixture 18 secures component 24 to platform 38 and precisely locates component 24 relative to rotary machine 23. Work holding fixture 18 may also provide a reference location for control programs of rotary machine 23. While the techniques disclosed herein may apply to workpieces of any materials, component 24 may be a coverglass for an electronic device, such as a coverglass of a smartphone touchscreen.

In the example of FIG. 1, rotary tool 28 is illustrated as including abrasive surface 29. In this example, abrasive surface 29 may be utilized to improve the surface finish of machined features in component 24, such as holes and edge features in a coverglass. In some example, different rotary tools 28 may be used in series to iteratively improve the surface finish of the machined features. For example, system 10 may be utilized to provide a coarser grinding step using a first rotary tool 28, or set of rotary tools 28, followed by a finer abrading step using a second rotary tool 28, or set of rotary tools 28. In the same or different examples, a single rotary tool 28 may include different levels of abrasion to facilitate an iterative grinding and/or abrading process using fewer rotary tools 28. Each of these examples may reduce the cycle time for finishing and polishing a coverglass following the machining of the features in the coverglass as compared to other examples in which only a single grinding step is used to improve surface finish following machining of features in a coverglass.

In some examples, following grinding and/or abrading using system 10, a coverglass may be polished, e.g., using a separate polishing system to further improve the surface finish. In general, the better the surface finish prior to polishing, the less time is required to provide a desired surface finish following the polishing.

To abrade an edge of component 24 with system 10, controller 30 may issue instructions to spindle 26 to precisely apply abrasive surface 29 against one or more features of component 24 as spindle 26 rotates rotary tool 28. The instructions may include for example, instructions to precise follow the contours of features of component 24 with a single abrasive surface 29 of a rotary tool 28 as well as iteratively apply multiple abrasive surfaces 29 of one or more rotary tools 28 to different features of component 24.

In illustrative examples, a base layer of the abrasive surface 29 may be formed of a polymeric material. For example, the base layer may be formed from thermoplastics, for example; polypropylene, polyethylene, polycarbonate, polyurethane, polytetrafluoroethylene, polyethylene teraphthalate, polyethylene oxide, polysulphone, polyetherketone, polyetheretherketone, polyimides, polyphenylene sulfide, polystyrene, polyoxymethylene plastic, and the like; thermosets, for example polyurethanes, epoxy resin, phenoxy resins, phenolic resins, melamine resins, polyimides and urea-formaldehyde resins, radiation cured resins, or combinations thereof. The base layer may consist essentially of only one layer of material, or it may have a multilayered construction. For example, the base layer may include a plurality of layers, or layer stack, with the individual layers of the stack being coupled to one another with a suitable fastening mechanism (e.g, adhesive and/or primer layer). The base layer (or an individual layer of the layer stack) may have any shape and thickness. The thickness of the base layer (i.e., the dimension of the base layer in a direction normal to the first and second major surfaces) may be less than 10 mm, less than 5 mm, less than 1 mm, less than 0.5 mm, less than 0.25 mm, less than 0.125 mm, or less than 0.05 mm.

In the same or different examples, abrasive surface 29 may include a plurality of cavities interspaced between the outermost abrasive material of abrasive surface 29. For example, the shape of the cavities may be selected from among a number of geometric shapes such as a cubic, cylindrical, prismatic, hemispherical, rectangular, pyramidal, truncated pyramidal, conical, truncated conical, cross, post-like with a bottom surface which is arcuate or flat, or combinations thereof. Alternatively, some or all of the cavities may have an irregular shape. In some examples, each of the cavities has the same shape. Alternatively, any number of the cavities may have a shape that is different from any number of the other cavities.

In various examples, one or more of the side or inner walls that form the cavities may be perpendicular relative to the top major surface or, alternatively, may be tapered in either direction (i.e., tapered toward the bottom of the cavity or toward the top of the cavity—toward the major surface). The angle forming the taper can range from about 1 to 75 degrees, from about 2 to 50 degrees, from about 3 to 35 degrees, or from between about 5 to 15 degrees. The height, or depth, of the cavities can be at least 1 μm, at least 10 μm, or at least 500 μm, or at least 800 um; less than 10 mm, less than 5 mm, or less than 1 mm. The height of the cavities may be the same, or one or more of the cavities may have a height that is different than any number of other cavities.

In illustrative examples, one or more (up to all) of the cavities may be formed as pyramids, or truncated pyramids. Such pyramidal shapes may have three to six sides (not including the base side), although a larger or smaller number of sides may be employed.

In some examples, the cavities can be provided in an arrangement in which the cavities are in aligned rows and columns. In some instances, one or more rows of cavities can be directly aligned with an adjacent row of cavities. Alternatively, one or more rows of cavities can be offset from an adjacent row of cavities. In further examples, the cavities can be arranged in a spiral, helix, corkscrew, or lattice fashion. In still further examples, the composites can be deployed in a "random" array (i.e., not in an organized pattern).

In some examples, abrasive surface 29 may be formed as a two-dimensional abrasive material, such as a convention abrasive sheet with a layer of abrasive particles held to a backing by one or more resin or other binder layers, such abrasive sheet may then be applied to a rotary tool substrate. Alternatively, abrasive surface 29 may be formed as a three-dimensional fixed abrasive, such as a resin or other binder layer that contains abrasive particles dispersed therein. The combination of abrasive particles and resin or binder, is herein referred to as an abrasive composite. In either example, abrasive surface 29 may include an abrasive composite which has appropriate height to allow for the abrasive composite to wear during use and/or dressing to expose a fresh layer of abrasive particles. The abrasive article may comprise a three-dimensional, textured, flexible, fixed abrasive construction including a plurality of precisely shaped abrasive composites.

The precisely shaped abrasive composites may be arranged in an array to form the three-dimensional, textured, flexible, fixed abrasive construction. Suitable arrays include, for instance, those described in U.S. Pat. No. 5,958,794 (Bruxvoort et al.). The abrasive article may comprise abrasive constructions that are patterned. Abrasive articles available under the trade designation TRIZACT patterned abrasive and TRIZACT diamond tile abrasives available from 3M Company, St. Paul, Minn., are exemplary patterned abrasives. Patterned abrasive articles include monolithic rows of abrasive composites precisely aligned and manufactured from a die, mold, or other techniques. Such patterned abrasive articles can abrade, polish, or simultaneously abrade and polish.

The shape of each precisely shaped abrasive composite may be selected for the particular application (e.g., workpiece material, working surface shape, contact surface shape, temperature, resin phase material). The shape of each precisely shaped abrasive composite may be any useful shape, e.g., cubic, cylindrical, prismatic, right parallelepiped, pyramidal, truncated pyramidal, conical, hemispherical, truncated conical, cross, or post-like sections with a distal end. Composite pyramids may, for instance, have three, four sides, five sides, or six sides. The cross-sectional shape of the abrasive composite at the base may differ from the cross-sectional shape at the distal end. The transition between these shapes may be smooth and continuous or may occur in discrete steps. The precisely shaped abrasive composites may also have a mixture of different shapes. The precisely shaped abrasive composites may be arranged in rows, spiral, helix, or lattice fashion, or may be randomly placed. The precisely shaped abrasive composites may be arranged in a design meant to guide fluid flow and/or facilitate swarf removal.

The lateral sides forming the precisely shaped abrasive composite may be tapered with diminishing width toward the distal end. The tapered angle may be from about 1 to less than 90 degrees, for instance, from about 1 to about 75 degrees, from about 3 to about 35 degrees, or from about 5 to about 15 degrees. The height of each precisely shaped abrasive composite is preferably the same, but it is possible to have precisely shaped abrasive composites of varying heights in a single article.

The base of the precisely shaped abrasive composites may abut one another or, alternatively, the bases of adjacent precisely shaped abrasive composites may be separated from one another by some specified distance. In some examples, the physical contact between adjacent abrasive composites involves no more than 33% of the vertical height dimension of each contacting precisely shaped abrasive composite. This definition of abutting also includes an arrangement where adjacent precisely shaped abrasive composites share a common land or bridge-like structure which contacts and extends between facing lateral surfaces of the precisely shaped abrasive composites. The abrasives are adjacent in the sense that no intervening composite is located on a direct imaginary line drawn between the centers of the precisely shaped abrasive composites.

The precisely shaped abrasive composites may be set out in a predetermined pattern or at a predetermined location within the abrasive article. For example, when the abrasive article is made by providing an abrasive/resin slurry between a backing and mold, the predetermined pattern of the precisely shaped abrasive composites will correspond to the pattern of the mold. The pattern is thus reproducible from abrasive article to abrasive article.

The predetermined patterns may be in an array or arrangement, by which is meant that the composites are in a designed array such as aligned rows and columns, or alternating offset rows and columns. In another example, the abrasive composites may be set out in a "random" array or pattern. By this is meant that the composites are not in a regular array of rows and columns as described above. It is understood, however, that this "random" array is a predetermined pattern in that the location of the precisely shaped abrasive composites is predetermined and corresponds to the mold.

An abrasive material forming abrasive surface 29 may include a polymeric material, such as a resin. In some examples, the resin phase may include a cured or curable organic material. The method of curing is not critical, and may include, for instance, curing via energy such as UV light or heat. Examples of suitable resin phase materials include, for instance, amino resins, alkylated urea-formaldehyde resins, melamine-formaldehyde resins, and alkylated benzoguanamine-formaldehyde resins. Other resin phase materials include, for instance, acrylate resins (including acrylates and methacrylates), phenolic resins, urethane resins, and epoxy resins. Particular acrylate resins include, for instance, vinyl acrylates, acrylated epoxies, acrylated urethanes, acrylated oils, and acrylated silicones. Particular phenolic resins include, for instance, resole and novolac resins, and phenolic/latex resins. In the same or different examples, the resin may include one or more of an epoxy resin, a polyester resin, a polyvinyl butyral (PVB) resin, an acrylic resin, thermal plastic resin, a thermally curable resin, an ultraviolet light curable resin, and an electromagnetic radiation curable resin. For example, an epoxy resin may represent between about 20 percent to about 35 percent by weight of the abrasive material. In the same or different examples, a polyester resin represents between 1 percent to 10 percent by weight of the abrasive material. The resins may further contain conventional fillers and curing agents such as are described, for instance, in U.S. Pat. No. 5,958,794 (Bruxvoort et al.), incorporated herein by reference.

Examples of suitable abrasive particles for the fixed abrasive pad include cubic boron nitride, fused aluminum oxide, ceramic aluminum oxide, heat treated aluminum oxide, white fused aluminum oxide, black silicon carbide, green silicon carbide, titanium diboride, boron carbide, silicon nitride, tungsten carbide, titanium carbide, diamond, cubic boron nitride, hexagonal boron nitride, alumina zirconia, iron oxide, ceria, garnet, fused alumina zirconia, alumina-based sol gel derived abrasive particles and the like. The alumina abrasive particle may contain a metal oxide modifier. Examples of alumina-based sol gel derived abrasive particles can be found in U.S. Pat. Nos. 4,314,827; 4,623,364; 4,744,802; 4,770,671; and 4,881,951, all incorporated by reference herein. The diamond and cubic boron nitride abrasive particles may be mono crystalline or polycrystalline. Other examples of suitable inorganic abrasive particles include silica, iron oxide, chromia, ceria, zirconia, titania, tin oxide, gamma alumina, and the like.

In some examples, an abrasive surface 29 may further include a backing layer behind an abrasive composite layer, optionally with an adhesive interposed therebetween. Any variety of backing materials are contemplated, including both flexible backings and backings that are more rigid. Examples of flexible backings include, for instance, polymeric film, primed polymeric film, metal foil, cloth, paper, vulcanized fiber, nonwovens and treated versions thereof and combinations thereof. Examples include polymeric films of polyester, and co-polyester, micro-voided polyester, polyimide, polycarbonate, polyamide, polyvinyl alcohol, polypropylene, polyethylene, and the like. When used as a backing, the thickness of a polymeric film backing is chosen such that a desired range of flexibility is retained in the abrasive article.

In some examples, an abrasive surface 29 may include one or more additional layers. For example, the abrasive surface may include adhesive layers such as pressure sensitive adhesives, hot melt adhesives, or epoxies. "Sub pads" such as thermoplastic layers, e.g. polycarbonate layers, which may impart greater stiffness to the pad, may be used for global planarity. Sub pads may also include elastically compressible material layers, e.g. foamed material layers. Sub pads which include combinations of both thermoplastic and compressible material layers may also be used. Additionally, or alternatively, metallic films for static elimination or sensor signal monitoring, optically clear layers for light transmission, foam layers for finer finish of the workpiece, or ribbed materials for imparting a "hard band" or stiff region to the polishing surface may be included.

As will be appreciated by those skilled in the art, abrasive surfaces 29 can be formed according to a variety of methods including, e.g., molding, extruding, embossing and combinations thereof.

In illustrative examples, the abrasive composites may include porous ceramic abrasive composites. The porous ceramic abrasive composites may include individual abrasive particles dispersed in a porous ceramic matrix. As used herein the term "ceramic matrix" includes both glassy and crystalline ceramic materials. These materials generally fall within the same category when considering atomic structure. The bonding of the adjacent atoms is the result of process of electron transfer or electron sharing. Alternatively, weaker bonds as a result of attraction of positive and negative charge known as secondary bond can exist. Crystalline ceramics, glass and glass ceramics have ionic and covalent bonding. Ionic bonding is achieved as a result of electron transfer from one atom to another. Covalent bonding is the result of sharing valence electrons and is highly directional. By way of comparison, the primary bond in metals is known as a metallic bond and involves non-directional sharing of electrons. Crystalline ceramics can be subdivided into silica based silicates (such as fireclay, mullite, porcelain, and Portland cement), non-silicate oxides (e.g., alumna, magnesia, $MgAl_2O_4$, and zirconia) and non-oxide ceramics (e.g., carbides, nitrides and graphite). Glass ceramics are comparable in composition with crystalline ceramics. As a result of specific processing techniques, these materials do not have the long range order crystalline ceramics do. Glass ceramics are the result of controlled heat-treatment to produce at least about 30% crystalline phase and up to about 90% crystalline phase or phases.

In illustrative examples, at least a portion of the ceramic matrix includes glassy ceramic material. In further examples, the ceramic matrix includes at least 50% by weight, 70% by weight, 75% by weight, 80% by weight, or 90% by weight glassy ceramic material. In one example, the ceramic matrix consists essentially of glassy ceramic material. Of particular usefulness for edge grinding coverglass, the ceramic matrix includes at least 30% by weight glassy ceramic material.

In various examples, the ceramic matrixes may include glasses that include metal oxides, for example, aluminum oxide, boron oxide, silicon oxide, magnesium oxide, sodium oxide, manganese oxide, zinc oxide, and mixtures thereof. A ceramic matrix may include alumina-borosilicate glass including $Si_2O$, $B_2O_3$, and $Al_2O_3$. The alumina-borosilicate glass may include about 18% $B_2O_3$, 8.5% $Al_2O_3$, 2.8% BaO, 1.1% CaO, 2.1% $Na_2O$, 1.0% $Li_2O$ with the balance being $Si_2O$. Such an alumina-borosilicate glass is commercially available from Specialty Glass Incorporated, Oldsmar Fla.

As used herein the term "porous" is used to describe the structure of the ceramic matrix which is characterized by having pores or voids distributed throughout its mass. A porous ceramic matrix may be formed by techniques well known in the art, for example, by controlled firing of a ceramic matrix precursor or by the inclusion of pore forming agents, for example, glass bubbles, in the ceramic matrix precursor. The pores may be open to the external surface of the composite or sealed. Pores in the ceramic matrix are believed to aid in the controlled breakdown of the ceramic abrasive composites leading to a release of used (i.e., dull) abrasive particles from the composites. The pores may also increase the performance (e.g., cut rate and surface finish) of the abrasive article, by providing a path for the removal of swarf and used abrasive particles from the interface between the abrasive article and the workpiece. The voids (or pore volume) may comprise from about at least 4 volume % of the composite, at least 7 volume % of the composite, at least 10 volume % of the composite, or at least 20 volume % of the composite; less than 95 volume % of the composite, less than 90 volume % of the composite, less than 80 volume % of the composite, or less than 70 volume % of the composite. Of particular usefulness for edge grinding coverglass, the voids may comprise from between 35 percent to 65 percent by weight of the abrasive material.

In some examples, the abrasive particles may include diamond, cubic boron nitride, fused aluminum oxide, ceramic aluminum oxide, heated treated aluminum oxide, silicon carbide, boron carbide, alumina zirconia, iron oxide, ceria, garnet, and combinations thereof. In one example, the abrasive particles may include or consist essentially of diamond. Diamond abrasive particles may be natural or synthetically made diamond. The diamond particles may have a blocky shape with distinct facets associated with them or, alternatively, an irregular shape. The diamond particles may be mono-crystalline or polycrystalline such as diamond commercially available under the trade designation "Mypolex" from Mypodiamond Inc., Smithfield Pa. Monocrystalline diamond of various particles size may be obtained from Diamond Innovations, Worthington, Ohio. Polycrystalline diamond may be obtained from Tomei Corporation of America, Cedar Park, Tex. The diamond particles may contain a surface coating such as a metal coating (nickel, aluminum, copper or the like), an inorganic coating (for example, silica), or an organic coating.

In some examples, the abrasive particles may include a blend of abrasive particles. For example, diamond abrasive particles may be mixed with a second, softer type of abrasive particles. In such instance, the second abrasive particles may have a smaller average particle size than the diamond abrasive particles.

In illustrative examples, the abrasive particles may be uniformly (or substantially uniformly) distributed throughout the ceramic matrix. As used herein, "uniformly distributed" means that the unit average density of abrasive particles in a first portion of the composite particle does not vary by more than 20%, more than 15%, more than 10%, or more than 5% when compared with any second, different portion of the composite particle. This is in contrast to, for example, an abrasive composite particle having abrasive particles concentrated at the surface of the particle.

In various examples, the abrasive composite particles may also include optional additives such as fillers, coupling agents, surfactants, foam suppressors and the like. The amounts of these materials may be selected to provide desired properties. Additionally, the abrasive composite particles may include (or have adhered to an outer surface thereof) one or more parting agents. As will be discussed in further detail below, one or more parting agents may be used in the manufacture of the abrasive composite particles to prevent aggregation of the particles. Useful parting agents may include, for example, metal oxides (e.g, aluminum oxide), metal nitrides (e.g., silicon nitride), graphite, and combinations thereof.

In some examples, the abrasive composites useful in the articles and methods may have an average size (average major axial diameter or longest straight line between two points on a composite) of about at least 5 μm, at least 10 μm, at least 15 μm, or at least 20 μm; less than 1,000 μm, less than 500 μm, less than 200 μm, or less than 100 μm. Abrasive particles particularly useful for edge grinding coverglass may have an average particle size of less than about 65 μm and a max particle size of less than about 500 μm.

In illustrative examples, the average size of the abrasive composites is at least about 3 times the average size of the abrasive particles used in the composites, at least about 5 times the average size of the abrasive particles used in the composites, or at least about 10 times the average size of the abrasive particles used in the composites; less than 30 times the average size of the abrasive particles used in the composites, less than 20 times the average size of the abrasive particles used in the composites, or less than 10 times the average size of the abrasive particles used in the composites. Abrasive particles useful in the articles and methods may have an average particle size (average major axial diameter (or longest straight line between two points on a particle)) of at least about 0.5 μm, at least about 1 μm, or at least about 3 μm; less than about 300 μm, less than about 100 μm, or less than about 50 μm. The abrasive particle size may be selected to, for example, provide a desired cut rate and/or desired surface roughness on a workpiece. The abrasive particles may have a Mohs hardness of at least 8, at least 9, or at least 10.

In various examples, the weight of abrasive particles to the weight of glassy ceramic material in the ceramic matrix of the ceramic abrasive composites is at least about 1/20, at least about 1/10, at least about 1/6, at least about 1/3, less than about 30/1, less than about 20/1, less than about 15/1 or less than about 10/1.

In various examples, a ratio of abrasive particle size to agglomerate size may be no greater than 15 to 1, of no greater than 12.5 to 1, of no greater than 10 to 1. In some examples, a ratio of abrasive size to agglomerate size may also be no less than about 3 to 1, no less than about 5 to 1 or even no less than about 7 to 1. Ceramic abrasive composites providing such ratios of abrasive size to agglomerate size may be particularly useful for edge grinding coverglass.

In various examples, the abrasive composites may be sized and shaped relative to the size and shape of the cavities of the abrasive surface 29 such that one or more (up to all) of the abrasive composites may be at least partially disposed within a cavity. More specifically, abrasive composites may be sized and shaped relative to the cavities such that one or more (up to all) of the abrasive composites, when fully received by a cavity, has at least a portion that extends beyond the cavity opening. As used herein, the phrase "fully received," as it relates to the position of a composite within a cavity, refers to the deepest position the composite may achieve within a cavity upon application of a non-destructive compressive force (such as that which is present during a polishing operation, as discussed below). In this manner, a polishing operation, the abrasive composite particles of the polishing solution may be received in and retained by (e.g., via frictional forces) the cavities, thereby functioning as an abrasive working surface.

In various examples, the amount of porous ceramic matrix in the ceramic abrasive composites is at least 5, at least 10, at least 15, at least 33, less than 95, less than 90, less than 80, or less than 70 weight percent of the total weight of the porous ceramic matrix and the individual abrasive particles, where the ceramic matrix includes any fillers, adhered parting agent and/or other additives other than the abrasive particles.

In various examples, the abrasive composite particles may be precisely-shaped or irregularly shaped (i.e., non-precisely-shaped). Precisely-shaped ceramic abrasive composites may be any shape (e.g., cubic, block-like, cylindrical, prismatic, pyramidal, truncated pyramidal, conical, truncated conical, spherical, hemispherical, cross, or post-like). The abrasive composite particles may be a mixture of different abrasive composite shapes and/or sizes. Alternatively, the abrasive composite particles may have the same (or substantially the same) shape and/or size. Non-precisely shaped particles include spheroids, which may be formed from, for example, a spray drying process.

The abrasive composite particles may be formed by any particle forming processes including, for example, casting, replication, microreplication, molding, spraying, spray-drying, atomizing, coating, plating, depositing, heating, curing, cooling, solidification, compressing, compacting, extrusion, sintering, braising, atomization, infiltration, impregnation, vacuumization, blasting, breaking (depending on the choice of the matrix material) or any other available method. The composites may be formed as a larger article and then broken into smaller pieces, as for example, by crushing or by breaking along score lines within the larger article. If the composites are formed initially as a larger body, it may be desirable to select for use fragments within a narrower size range by one of the methods known to those familiar with the art. In some examples, the ceramic abrasive composites may include vitreous bonded diamond agglomerates produced generally using techniques disclosed in of U.S. Pat. Nos. 6,551,366 and 6,319,108. Of particular usefulness for edge grinding coverglass, a volume ratio of diamond agglomerates to a resin binder within the abrasive is greater than 3 to 2

Of particular usefulness for edge grinding coverglass, the ceramic abrasive agglomerates may represent between 35 percent to 65 percent by weight of the abrasive material.

Generally, a method for making the ceramic abrasive composite includes mixing an organic binder, solvent, abrasive particles, e.g. diamond, and ceramic matrix precursor particles, e.g. glass frit; spray drying the mixture at elevated temperatures producing "green" abrasive/ceramic matrix/binder particles; the "green" abrasive/ceramic matrix/binder particles are collected and mixed with a parting agent, e.g. plated white alumina; the powder mixture is then annealed at a temperature sufficient to vitrify the ceramic matrix material that contains the abrasive particles while removing the binder through combustion; forming the ceramic abrasive composite. The ceramic abrasive composites can optionally be sieved to the desired particle size. The parting agent prevents the "green" abrasive/ceramic matrix/binder particles from aggregating together during the vitrifying process. This enables the vitrified, ceramic abrasive composites to maintain a similar size as that of the "green" abrasive/ceramic matrix/binder particles formed directly out of the spray drier. A small weight fraction, less than 10%, less 5% or even less than 1% of the parting agent may adhere to the outer surface of the ceramic matrix during the vitrifying process. The parting agent typically has a softening point (for glass materials and the like), or melting point (for crystalline materials and the like), or decomposition temperature, greater than the softening point of the ceramic matrix, wherein it is understood that not all materials have each of a melting point, a softening point, or a decomposition temperature. For a material that does have two or more of a melting point, a softening point, or a decomposition temperature, it is understood that the lower of the melting point, softening point, or decomposition temperature is greater than the softening point of the ceramic matrix. Examples of useful parting agents include, but are not limited to, metal oxides (e.g. aluminum oxide), metal nitrides (e.g. silicon nitride) and graphite.

In some examples, the abrasive composite particles may be surface modified (e.g., covalently, ionically, or mechanically) with reagents which will impart properties beneficial to abrasive slurries. For example, surfaces of glass can be etched with acids or bases to create appropriate surface pH. Covalently modified surfaces can be created by reacting the particles with a surface treatment comprising one or more surface treatment agents. Examples of suitable surface treatment agents include silanes, titanates, zirconates, organophosphates, and organosulfonates. Examples of silane surface treatment agents suitable for this invention include octyltriethoxysilane, vinyl silanes (e.g., vinyltrimethoxysilane and vinyl triethoxysilane), tetramethyl chloro silane, methyltrimethoxysilane, methyltriethoxysilane, propyltrimethoxysilane, propyltriethoxysilane, tris-[3-(trimethoxysilyl)propyl] isocyanurate, vinyl-tris-(2-methoxyethoxy)silane, gamm-methacryloxypropyltrimethoxysilane, beta-(3,4-epoxycyclohexyl)ethyltrimethoxysilane, gamma-glycidoxypropyltrimethoxysilane gamma-mercaptopropyltrimethoxysilane, gamma-aminopropyltriethoxysilane, gamma-aminopropyltrimethoxysilane, N-beta-(aminoethyl)-gamma-aminopropyltrimethoxysilane, bis-(gamma-trimethoxysilylpropyl)amine, N-phenyl-gamma-aminopropyltrimethoxysilane, gamma-ureidopropyltrialkoxysilane, gamma-ureidopropyltrimethoxysilane, acryloxyalkyl trimethoxysilane, methacryloxyalkyl trimethoxysilane, phenyl trichlorosilane, phenyltrimethoxysilane, phenyl triethoxysilane, SILQUEST A1230 proprietary non-ionic silane dispersing agent (available from Momentive, Columbus, Ohio) and mixtures thereof. Examples of commercially available surface treatment agents include SILQUEST A 174 and SILQUEST A 1230 (available from Momentive). The surface treatment agents may be used to adjust the hydrophobic or hydrophilic nature of the surface it is modifying. Vinyl silanes can be used to provide an even more sophisticated surface modification by reacting the vinyl group w/another reagent. Reactive or inert metals can be combined with the glass diamond particles to chemically or physically change the surface. Sputtering, vacuum evaporation, chemical vapor deposition (CVD) or molten metal techniques can be used.

In addition to resin, such as epoxy resin, and abrasive composite particles, the abrasive material may include additional additives, such as a filler material or other material. In some examples, a filler material may include one or more of aluminum oxide, non-woven fibers, silicon carbide and ceria particles. In such examples, the filler material may represent between 5 percent to 50 percent by weight of the abrasive material. Such examples may be particularly useful for abrasive materials used for edge grinding coverglass.

As another example, the abrasive material may include metal particles dispersed within the resin in combination with the abrasive composite particles. Metal particles may provide a bearing effect to protect the resin during a grinding operation. Such metal particles may include one or more of copper particles, tin particles, brass particles, aluminum particles, stainless steel particles and metal alloys. For example, the metal particles may represent between 5 percent to 25 percent by weight of the abrasive material. In the same or different examples, the metal particles may have an average particle size of between 10 micrometers to 250 micrometers, such as between 44 micrometers to 149 micrometers, such as about 100 micrometers. Such examples may be particularly useful for abrasive materials used for edge grinding coverglass.

Polymethyl methacrylate beads are another optional additive that may be dispersed within the resin of the abrasive material. In such examples, the polymethyl methacrylate beads may represent between 1 percent to 10 percent by weight of the abrasive material. Such examples may be particularly useful for abrasive materials used for edge grinding coverglass.

In various examples, abrasive materials as described herein may be used to form an abrasive surface of an abrasive rotary tool particularly suitable for edge grinding coverglass. In some examples, the abrasive material, including resin, abrasive composite particles, and any additional additives dispersed in the resin, may be molded to form the abrasive surface or even an entire rotary tool 28. For example, the abrasive material may be overmolded on a core of a rotary tool 28 to form the abrasive surface. In general, such a core would include the tool shank as well as a portion embedded in the abrasive material in order to mechanically secure the abrasive material to the tool shank.

In other examples, the abrasive material may be a coating on a substrate. In different examples, the substrate may represent a core of a rotary tool 28 providing the shape of the rotary tool, with the abrasive applied directly to the core of the rotary tool. In other examples, the substrate may represent a sheet material later applied to a core of a rotary tool. In such examples, the substrate may be a flat substrate or a curved substrate. In various examples, the substrate may include one or more of a polymer film, a non-woven substrate, a woven substrate, a rubber substrate, an elastic substrate, a foam substrate, a conformable material, an extruded film, a primed substrate, and an unprimed substrate.

In some particular examples, an abrasive material coating may be formed from an abrasive composite layer deposited polymeric film with a primer layer between the abrasive composite layer and the polymeric film. The polymeric film itself may be positioned over a compliant layer, such as a foam, with an adhesive securing the polymeric film to the complaint layer. The combined abrasive material coating, polymeric material and complaint material may then be applied to core of rotary tool 28 in order to form the shape of abrasive surface 29 on rotary tool 28. In some examples, the abrasive material may be further cured after being applied to the core of the rotary tool 28, for example, as described with respect to FIG. 10.

FIGS. 2 and 4A-9 illustrate example rotary abrasive tools suitable for grinding of a glass, such as a coverglass, sapphire, ceramics, and the like, whereas FIG. 3 illustrates a coverglass for an electronic device. Each of the tools of FIGS. 2 and 4A-9 may include an abrasive material as described herein, and may be utilized as rotary tool 28 within system 10 (FIG. 1).

Figure 2:
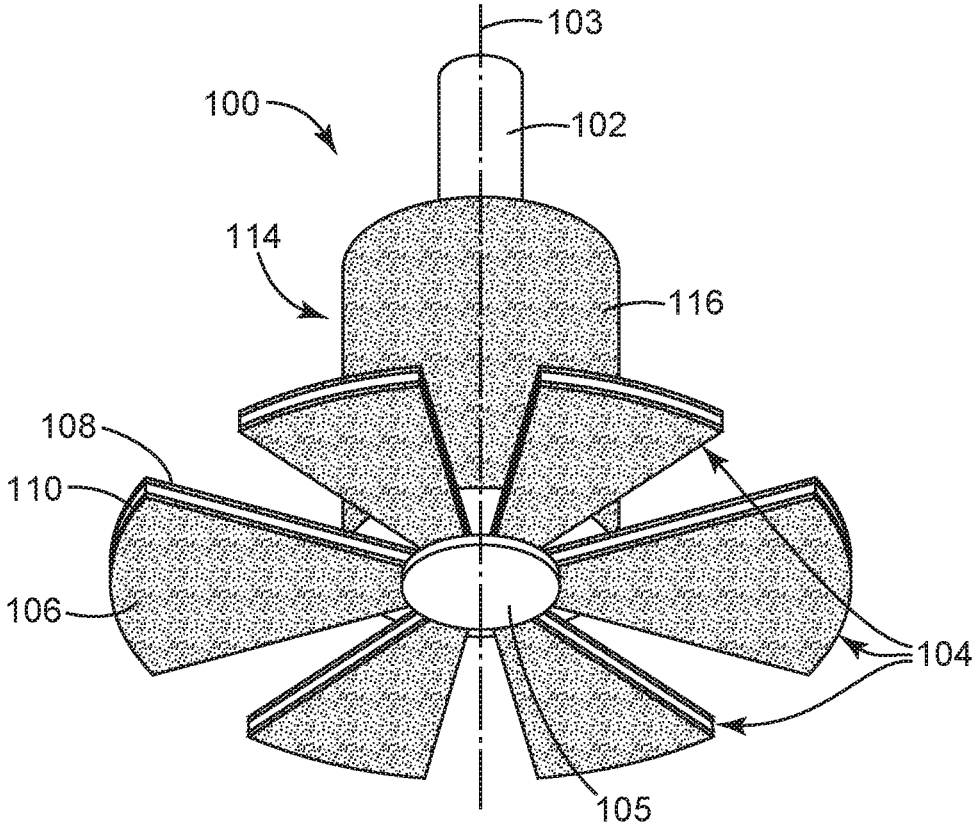
FIG. 2 illustrates an example rotary abrasive tool including a set of flexible flaps with an abrasive external surface that facilitates abrading an edge of a workpiece across multiple angles through bending of the flexible flaps.

In particular, FIG. 2 illustrates an example rotary abrasive tool 100. Rotary abrasive tool 100 includes a set of flexible flaps 104 with abrasive external surface 106, 108 that facilitate abrading an edge of a workpiece across multiple angles through bending of the flexible flaps. Rotary abrasive tool 100 further includes tool shank 102, which defines an axis of rotation for tool 100. Flexible flaps 104 may secured to tool shank 102 with an optional fixation mechanism 105, which may represent a pin, screw, rivet or other fixation mechanism. Tool shank 102 may be configured to mount within a chuck of a rotary machine, such as a drill or CNC machine.

Flexible flaps 104 form a flexible planar section positioned opposite tool shank 102. Each of flexible flaps 104 form a first abrasive external surface 106 on a first side of the flexible flaps 104, the first side of flexible flaps 104 facing generally away from tool shank 102. Each of flexible flaps 104 also form an optional second abrasive external surface 108 on a second side of flexible flaps 104, the second side of flexible flaps 104 facing in the general direction of tool shank 102. Optional substrate 110 is located between first abrasive external surface 106 and second abrasive external surface 108. In some examples, substrate 110 may include an elastically compressible layer backing abrasive external surfaces 106, 108.

Rotary abrasive tool 100 further includes cylindrical section 114 attached to tool shank 102. Cylindrical section 114 forms third abrasive external surface 116 surrounding the axis of rotation 103. Cylindrical section 114 may further include an optional elastically compressible layer backing abrasive external surface 116. Flexible flaps 104 extend past the outer diameter of cylindrical section 114 relative to axis of rotation 103.

One or more of abrasive external surfaces 106, 108 and 116 may include an abrasive coating as previously described herein. In the same or different examples, one or more of abrasive external surfaces 106, 108 and 116 may include an abrasive film as also previously described herein. Such abrasives may be secured to a substrate of tool 100, such as substrate 110, with an epoxy.

In different examples, as described herein, the abrasive of one or more of abrasive external surfaces 106, 108 and 116 may provide an abrasive grain size of less than 20 micrometers, such as an abrasive grain size of between about 10 micrometers and about 1 micrometer, such as an abrasive grain size of about 3 micrometers. Such examples may be particularly useful for edge grinding of a coverglass.

In some examples, third abrasive external surface 116 of cylindrical section 114 may include portions with different abrasive grain sizes from one another. In such examples, the different portions may be utilized in series to provide improved surface finish or speed for surface finishing during a grinding operation, such as edge grinding of a coverglass.

Figure 4A:
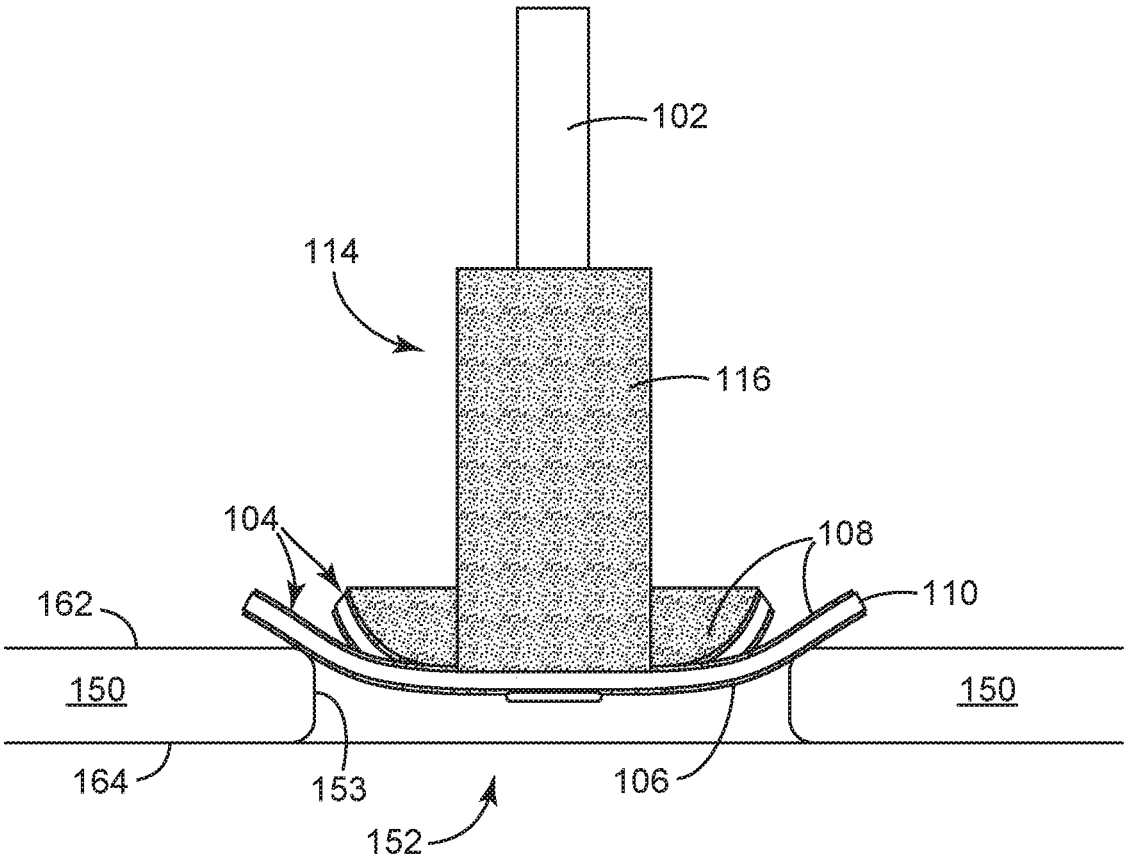
FIGS. 4A-4C illustrate the rotary abrasive tool of FIG. 2 being used to abrade a partially-finished coverglass.
Figure 4B:
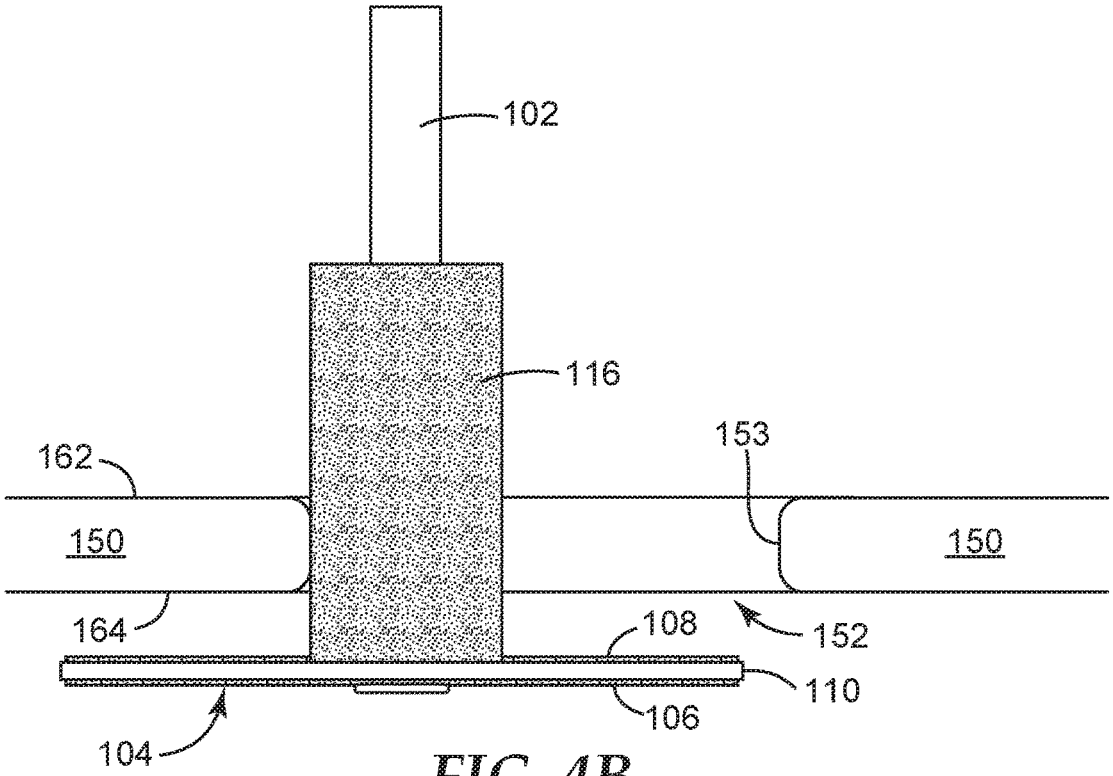
Figure 4C:
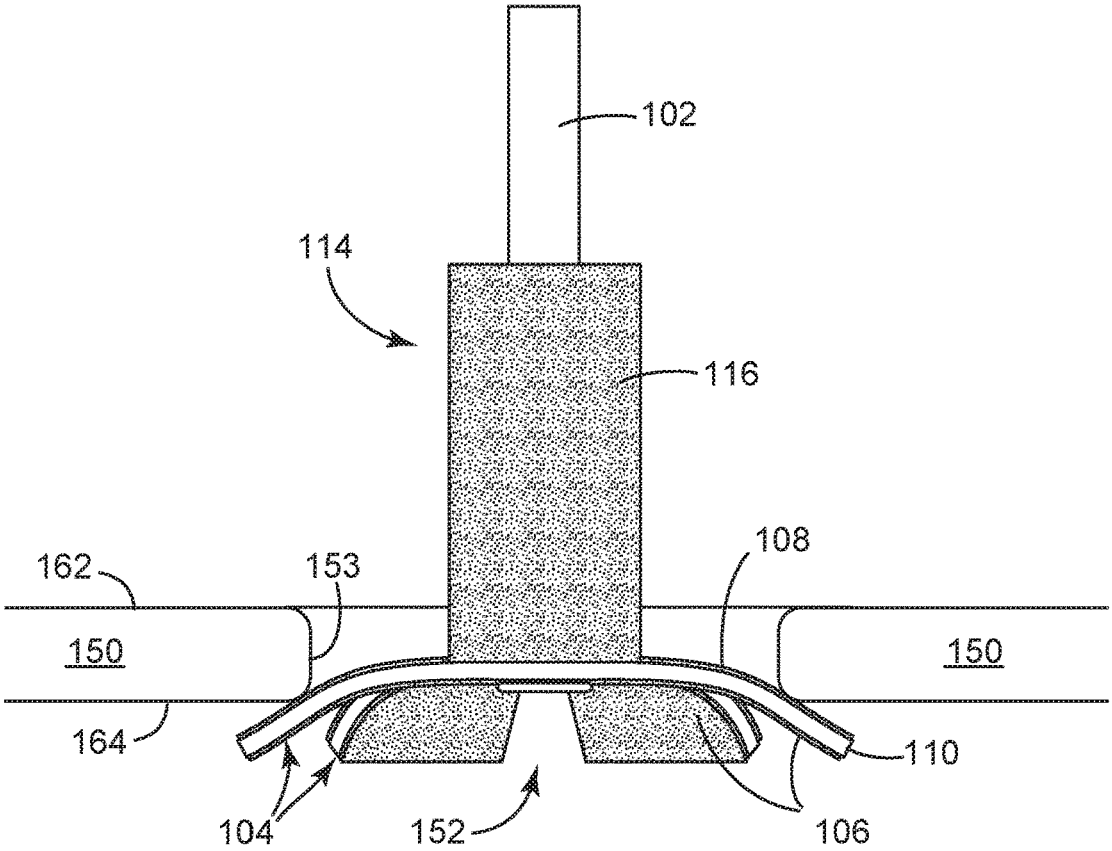

As described in further detail with respect to FIGS. 4A-4C, cylindrical section 114 facilitates abrading an edge of the workpiece between the first side of the workpiece and the second side of the workpiece while operating of tool 100 from tool shank 102. In addition, flexible flaps 104 facilitate abrading, with first abrasive external surface 106, a first corner adjacent to a first side of a workpiece across multiple angles relative to the axis of rotation for the rotary tool through bending of flexible flaps 104 when first abrasive external surface 106 is applied to the first corner of the workpiece. Similarly, flexible flaps 104 facilitates abrading, with second abrasive external surface 108, a second corner adjacent to a second side of the workpiece, the second side of the workpiece opposing the first side of the workpiece, across multiple angles relative to the axis of rotation for the rotary tool through bending of flexible flaps 104 when second abrasive external surface 108 is applied to the second corner of the workpiece.

FIG. 3 illustrates coverglass 150, which is a coverglass for an electronic device, a cellular phone, personal music player or other electronic device. In some examples, coverglass 150 may be a component of a touchscreen for the electronic device. Coverglass 150 may be an alumina-silicate based glass with a thickness of less than 1 millimeter, although other compositions are also possible.

Coverglass 150 includes a first major surface 162 opposing a second major surface 164. Generally, but not always, major surfaces 162, 164 are planar surfaces. Edge surface 166 follows the perimeter of major surfaces 162, 164, the perimeter including rounded corners 167. Coverglass 150 further forms a hole 152. Hole 152 includes its own edge surfaces, such as edge surface 153 (see FIG. 4A).

To provide an increased resistance to cracking and improved appearance, the surfaces of coverglass 150, including major surfaces 162, 164, edge surface 166 and the edge surfaces of hole 152, should be smoothed to the extent practical during manufacturing of coverglass 150. After machining to form the general shape of coverglass 150, the surfaces may be polished, e.g., using a CeO slurry, to remove grinding and machining marks in coverglass 150.

In addition, as disclosed herein, rotary abrasive tools, such as those described with respect to FIGS. 2 and 4A-9 may be used to reduce edge surface roughness, such as edge surface 166 and the edge surfaces of hole 152, using a CNC machine prior to polishing. The intermediate grinding step may reducing polishing time to provide desired surface finish qualities of coverglass 150 may not only reduce production time, but may also provide more precise dimensional control for the production of coverglass 150.

FIGS. 4A-4C illustrate rotary abrasive tool 100 being used to abrade coverglass 150, which may represent a partially-finished coverglass in that it has not yet be polished or hardened following machining to form its general shape. Rotary abrasive tool 100 may first be secured to a rotary tool holder of a CNC machine, such as rotary machine 23.

As illustrated in FIG. 4A, surface 106 of the flexible section of tool 100, flexible flaps 104, are being used to abrade the corners between edge 153 of hole 152 and major surface 162. The flexibility of flexible flaps 104 allows surface 106 to conform to the contours of the corners between edge 153 of hole 152 and major surface 162 as rotary abrasive tool 100 is pushed through hole 152, e.g., by a CNC machine according to a preprogrammed set of instructions. In different examples, these corners may be rounded, beveled or square prior to the abrading by tool 100. Likewise, the flexibility of flexible flaps 104 allows surface 106 to conform to the contours of other corners, including the corners of between edge 166 and major surface 162 to facilitate abrading these corners with surface 106. In different examples, the corners of between edge 166 and major surface 162 may be rounded, beveled or square prior to the abrading by tool 100. Similarly, any of tools 200, 400, 500 and 600, which are described below with respect to FIGS. 5 and 7-9, may also be used to abrade the corners of between edge 166 and major surface 162.

Flexible flaps 104 are also flexible enough to push entirely through hole 152, in order to allow abrasive external surface 116 of cylindrical section 114 to abrade edge 153 of hole 152, as shown in FIG. 4B. In addition, the flexibility of flexible flaps 104 allows surface 108 to conform to the contours of the corners between edge 153 of hole 152 and major surface 164 as rotary abrasive tool 100 is pulled back through hole 152, e.g., by the CNC machine. In different examples, these corners may be rounded, beveled or square prior to the abrading by tool 100. Likewise, the flexibility of flexible flaps 104 allows surface 106 to conform to the contours of other corners, including the corners of between edge 166 and major surface 164 to facilitate abrading these corners with surface 108. Similarly, any of tools 200, 400 and 500, which are described below with respect to FIGS. 5, 7 and 8, may also be used to abrade the corners of between edge 166 and major surface 162 at hole 152.

In this manner, tool 100 allows abrading all the surfaces associated with hole 152, including edge 153 and the corners between edge 153 and major surfaces 162, 164. Such abrading may occur by continuously rotating tool 100 while contacting the surfaces associated with hole 152 with abrasive surfaces 106, 116 and 108. Tool 100 also allows abrading all the surfaces associated with edge 166 including the corners between edge 166 and major surfaces 162, 164. Such abrading may occur by continuously rotating tool 100 while contacting the surfaces associated with edge 166 with abrasive surfaces 106, 116 and 108. Following the abrading of surfaces associated edges 153, 166 using tool 100, these surfaces may be polished using an abrasive slurry, such as a CeO slurry, to further improve the surface finish. In the same or different examples in which an abrasive slurry is used, tool 100 may be part of a set of two or more tools 100 that provide different levels of abrasion. For example, the tools may be used in series from a rougher levels of abrasiveness to lower levels of abrasiveness to refine the surface finish.

Figure 5:
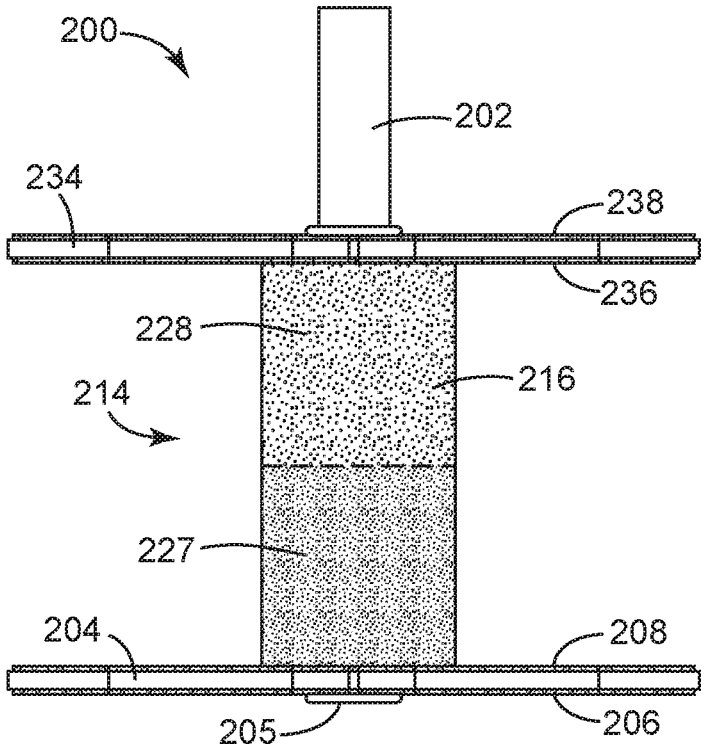
FIG. 5 illustrates an example rotary abrasive tool including two sets of flexible flaps with abrasive external surfaces, and the different flexible flaps may include different levels of abrasion.

FIG. 5 illustrates rotary abrasive tool 200. Rotary abrasive tool 200 is substantially similar to rotary abrasive tool 100, except that rotary abrasive tool 200 includes two sets of flexible flaps 204, 234 with abrasive external surfaces, rather than a single set of flexible flaps 104. Flexible flaps 204, 234 may include different levels of abrasion.

Rotary abrasive tool 200 includes two set of flexible flaps 204, 234 with abrasive external surfaces 206, 208, 236, 238 that facilitates abrading an edge of a workpiece across multiple angles through bending of the flexible flaps. Rotary abrasive tool 200 further includes tool shank 202, which defines an axis of rotation for tool 200. Flexible flaps 204 may secured to tool shank 202 with an optional fixation mechanism 205, which may represent a pin, screw, rivet or other fixation mechanism. Tool shank 202 may be configured to mount within a chuck of a rotary machine, such as a drill or CNC machine.

Flexible flaps 204 form a flexible planar section positioned opposite tool shank 202 relative to cylindrical section 214. Flexible flaps 204 extend past the outer diameter of cylindrical section 214 relative to the axis of rotation. Each of flexible flaps 204 form a first abrasive external surface 206 on a first side of the flexible flaps 204, the first side of flexible flaps 204 facing generally away from tool shank 202. Each of flexible flaps 204 also form an optional second abrasive external surface 208 on a second side of flexible flaps 204, the second side of flexible flaps 204 facing in the general direction of tool shank 202.

Rotary abrasive tool 200 further includes cylindrical section 214 attached to tool shank 202. Cylindrical section 214 forms third abrasive external surface 216 surrounding the axis of rotation for rotary abrasive tool 200. Abrasive external surface 216 includes two portions 227, 228 with different abrasive grain sizes. The different portions may be utilized in series to provide improved surface finish or speed for surface finishing during a grinding operation, such as edge grinding of a coverglass. In other examples, more than two abrasive grain sizes may be included.

Flexible flaps 234 form a flexible planar section positioned adjacent tool shank 202. Flexible flaps 234 extend past the outer diameter of cylindrical section 214 relative to the axis of rotation. Each of flexible flaps 234 form a first abrasive external surface 236 on a first side of the flexible flaps 234, the first side of flexible flaps 234 facing generally away from tool shank 202. Each of the flexible flaps 234 also form an optional second abrasive external surface 238 on a second side of flexible flaps 234, the second side of flexible flaps 234 facing in the general direction of tool shank 202.

One or more of abrasive external surfaces 206, 208, 216, 236 and 238 may include an abrasive coating as previously described herein. In the same or different examples, one or more of abrasive external surfaces 206, 208, 216, 236 and 238 may include an abrasive film as also previously described herein. Such abrasives may be secured to a substrate of tool 200 with an epoxy, adhesive or other material.

As described previously with respect to rotary tool 100, cylindrical section 214 facilitates abrading an edge of the workpiece between the first side of the workpiece and the second side of the workpiece while operating of tool 200 from tool shank 202. In addition, flexible flaps 204, 234 facilitate abrading, with one of first abrasive external surfaces 206, 236 a first corner adjacent to a first side of a workpiece across multiple angles relative to the axis of rotation for the rotary tool through bending of flexible flaps 204, 234 when the one of first abrasive external surfaces 206, 236 is applied to the first corner of the workpiece. Similarly, flexible flaps 204, 234 facilitate abrading, with one of second abrasive external surfaces 208, 238, a second corner adjacent to a second side of the workpiece, the second side of the workpiece opposing the first side of the workpiece, across multiple angles relative to the axis of rotation for the rotary tool through bending of flexible flaps 204, 234 when the one second one of abrasive external surface 208, 238 is applied to the second corner of the workpiece.

In some examples, abrasive external surface 206 may provide a larger abrasive grain size than abrasive external surface 236. And abrasive external surface 238 may provide a larger abrasive grain size than abrasive external surface 208. In this manner, as tool 200 is pushed entirely through a hole, a first edge is abraded by external surface 206, then external surface 236, whereas the opposing edge is first abraded by external surface 238, then external surface 208 as tool 200 is pulled from the hole.

Following the abrading of surfaces of a workpiece using tool 200, these surfaces may be polished using an abrasive slurry, such as a CeO slurry, to further improve the surface finish. In the same or different examples in which an abrasive slurry is used, tool 200 may be part of a set of two or more tools 200 that provide different levels of abrasion. For example, the tools may be used in series from a rougher levels of abrasiveness to lower levels of abrasiveness to refine the surface finish of a workpiece, such as coverglass 150.

Figure 6:
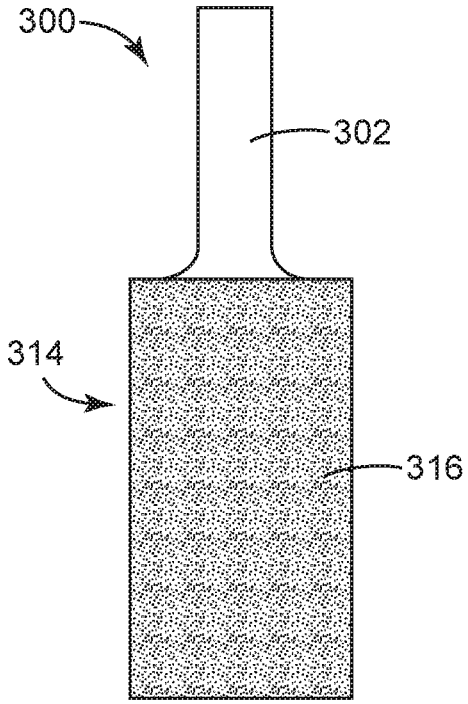
FIG. 6 illustrates an example rotary abrasive tool including an abrasive external surface forming a cylindrical shape in coaxial alignment with the axis of rotation for the rotary tool.

FIG. 6 illustrates rotary abrasive tool 300. Rotary abrasive tool 300 is substantially similar to rotary abrasive tool 100, except that rotary abrasive tool 300 does not include flexible flaps 104.

Rotary abrasive tool 300 includes tool shank 302, which defines an axis of rotation for tool 300. Tool shank 302 may be configured to mount within a chuck of a rotary machine, such as a drill or CNC machine. Rotary abrasive tool 300 further includes cylindrical section 314 in coaxial alignment with, and attached to, tool shank 302. Cylindrical section 314 forms an abrasive external surface 316 with circular cross sections perpendicular to the axis of rotation of tool 300. In some examples, two or more abrasive grain sizes may be included in different portions of abrasive external surface 316. Abrasive external surface 316 may include an abrasive coating as previously described herein. In the same or different examples, abrasive external surface 316 may include an abrasive film as also previously described herein.

Following the abrading of surfaces of a workpiece using tool 300, these surfaces may be polished using an abrasive slurry, such as a CeO slurry, to further improve the surface finish. In the same or different examples in which an abrasive slurry is used, tool 300 may be part of a set of two or more tools 300 that provide different levels of abrasion. For example, the tools may be used in series from a rougher levels of abrasiveness to lower levels of abrasiveness to refine the surface finish.

Figure 7:
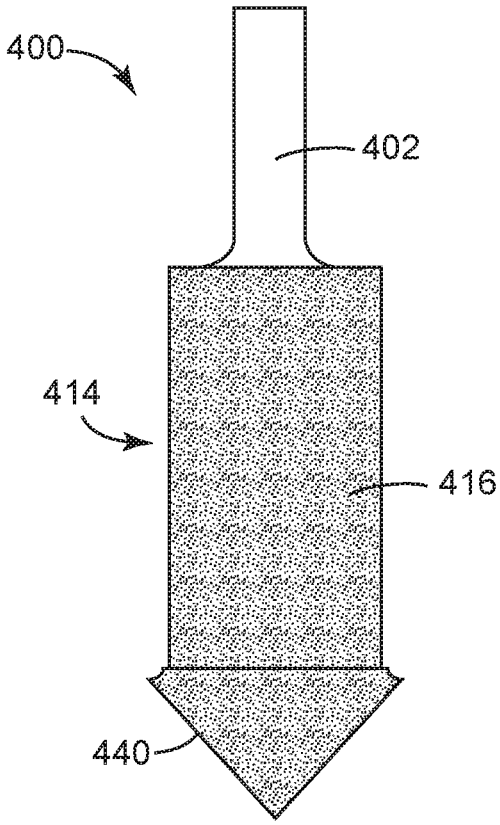
FIG. 7 illustrates an example rotary abrasive tool including an abrasive external surface forming a cylindrical shape in coaxial alignment with the axis of rotation for the rotary tool and an angled surface including an abrasive external surface for abrading a beveled edge of the workpiece.

FIG. 7 illustrates rotary abrasive tool 400. Rotary abrasive tool 400 is substantially similar to rotary abrasive tool 300, with the addition of an angled surface including an abrasive external surface 440 for abrading a beveled edge of a workpiece, such as coverglass 150.

Rotary abrasive tool 400 includes tool shank 402, which defines an axis of rotation for tool 400. Tool shank 402 may be configured to mount within a chuck of a rotary machine, such as a drill or CNC machine. Rotary abrasive tool 400 further includes cylindrical section 414 in coaxial alignment with, and attached to, tool shank 402. Cylindrical section 414 forms an abrasive external surface 416 with circular cross sections perpendicular to the axis of rotation of tool 400. In some examples, two or more abrasive grain sizes may be included in different portions of abrasive external surface 416.

Rotary abrasive tool 400 further includes second abrasive external surface 440, which forms an angled surface relative to the axis of rotation for abrasive tool 400. Abrasive external surface 440 may facilitate abrading interior or exterior beveled edges of the workpiece, such as workpiece 150. The shape of abrasive external surface 440 thereby corresponds to a desired finished shape of an edge of the workpiece. In other examples, a rotary tool may include different geometry to correspond to a desired finished shape of an edge of the workpiece.

Abrasive external surfaces 416, 440 may include an abrasive coating as previously described herein. In the same or different examples, one or more of abrasive external surfaces 416, 440 may include an abrasive film as also previously described herein.

Following the abrading of surfaces of a workpiece using tool 400, these surfaces may be polished using an abrasive slurry, such as a CeO slurry, to further improve the surface finish. In the same or different examples in which an abrasive slurry is used, tool 400 may be part of a set of two or more tools 400 that provide different levels of abrasion. For example, the tools may be used in series from a rougher levels of abrasiveness to lower levels of abrasiveness to refine the surface finish.

Figure 8:
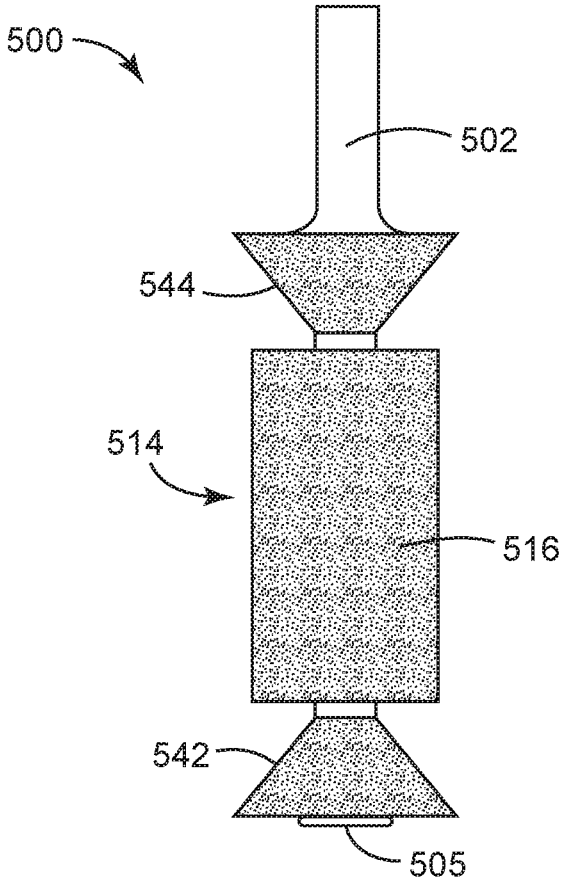
FIG. 8 illustrates an example rotary abrasive tool including a first abrasive external surface forming a cylindrical shape in coaxial alignment with the axis of rotation for the rotary tool, and first and second angled surfaces including abrasive external surfaces for abrading beveled edges of the workpiece.

FIG. 8 illustrates rotary abrasive tool 500. Rotary abrasive tool 500 is substantially similar to rotary abrasive tool 300, with the addition of an angled surfaces including an abrasive external surfaces 542, 544 for abrading beveled edges of a workpiece, such as coverglass 150.

Rotary abrasive tool 500 includes tool shank 502, which defines an axis of rotation for tool 500. Tool shank 502 may be configured to mount within a chuck of a rotary machine, such as a drill or CNC machine. Rotary abrasive tool 500 further includes cylindrical section 514 in coaxial alignment with, and attached to, tool shank 502. Cylindrical section 514 forms an abrasive external surface 516 with circular cross sections perpendicular to the axis of rotation of tool 500. In some examples, two or more abrasive grain sizes may be included in different portions of abrasive external surface 516.

Rotary abrasive tool 500 further includes abrasive external surfaces 542, 544 on either side of cylindrical section 514. Abrasive external surfaces 542, 544 form angled surfaces relative to the axis of rotation for abrasive tool 500. Abrasive external surface 542 may secured to tool shank 202 with an optional fixation mechanism 205, which may represent a pin, screw, rivet or other fixation mechanism. Abrasive external surfaces 542, 544 may facilitate abrading interior or exterior beveled edges of the workpiece, such as workpiece 150. For example, external surface 542 may be configured to facilitate abrading interior or exterior beveled edges on a first side of the workpiece, whereas external surface 542 may be configured to facilitate abrading interior or exterior beveled edges on a second side of the workpiece, the second side of the workpiece opposing the first side of the workpiece. The shape of abrasive external surfaces 542, 544 thereby corresponds to a desired finished shapes of the workpiece. In other examples, a rotary tool may include different geometry to correspond to a desired finished shape of an edge of the workpiece.

Abrasive external surfaces 516, 542, 544 may include an abrasive coating as previously described herein. In the same or different examples, one or more of abrasive external surfaces 516,542, 544 may include an abrasive film as also previously described herein.

Following the abrading of surfaces of a workpiece using tool 500, these surfaces may be polished using an abrasive slurry, such as a CeO slurry, to further improve the surface finish. In the same or different examples in which an abrasive slurry is used, tool 500 may be part of a set of two or more tools 500 that provide different levels of abrasion. For example, the tools may be used in series from a rougher levels of abrasiveness to lower levels of abrasiveness to refine the surface finish.

Figure 9:
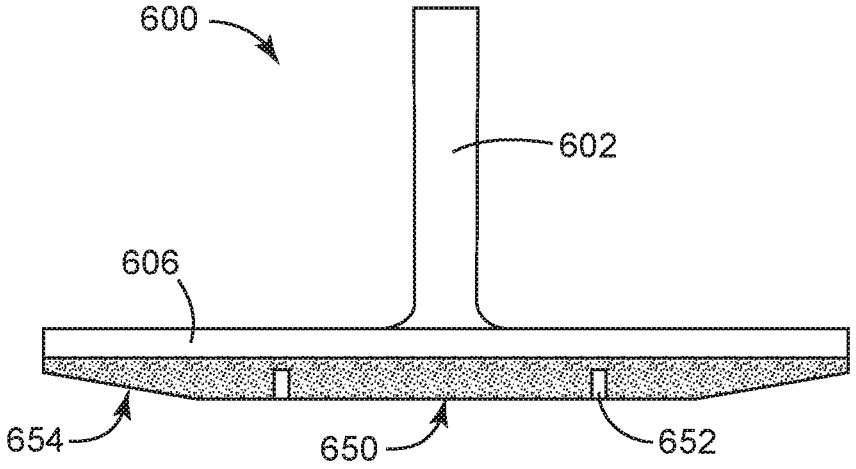
FIG. 9 illustrates an example rotary abrasive tool including an abrasive external surface forming a planar surface perpendicular with the axis of rotation for the rotary tool.

FIG. 9 illustrates an example rotary abrasive tool including an abrasive external surface forming a planar surface perpendicular with the axis of rotation for the rotary tool.

FIG. 6 illustrates rotary abrasive tool 600. Rotary abrasive tool 600 includes tool shank 602, which defines an axis of rotation for tool 600. Tool shank 602 may be configured to mount within a chuck of a rotary machine, such as a drill or CNC machine. Planar tool core 606 is mounted to tool shank 602 and perpendicular to the axis of rotation for tool 600. In some examples, planar tool core 606 and tool shank 602 may represent a unitary component.

Rotary abrasive tool 600 includes planar abrasive external surface 650, which is perpendicular to the axis of rotation for tool 600. Relief notches 552 are located within the surface of planar abrasive external surface 650 to facilitate debris removal during a grinding operation with tool 600. Rotary abrasive tool 600 also includes angled abrasive surface 654, which facilitates abrading interior or exterior beveled edges of a workpiece, such as coverglass 150. Planar abrasive external surface 650 and abrasive surface 654 provide circular cross sections perpendicular to the axis of rotation of tool 600.

Abrasive external surfaces 650, 654 may include an abrasive coating as previously described herein. In the same or different examples, abrasive external surfaces 650, 654 may include an abrasive film as also previously described herein.

Following the abrading of surfaces of a workpiece using tool 600, these surfaces may be polished using an abrasive slurry, such as a CeO slurry, to further improve the surface finish. In the same or different examples in which an abrasive slurry is used, tool 600 may be part of a set of two or more tools 600 that provide different levels of abrasion. For example, the tools may be used in series from a rougher levels of abrasiveness to lower levels of abrasiveness to refine the surface finish.

Figure 10:
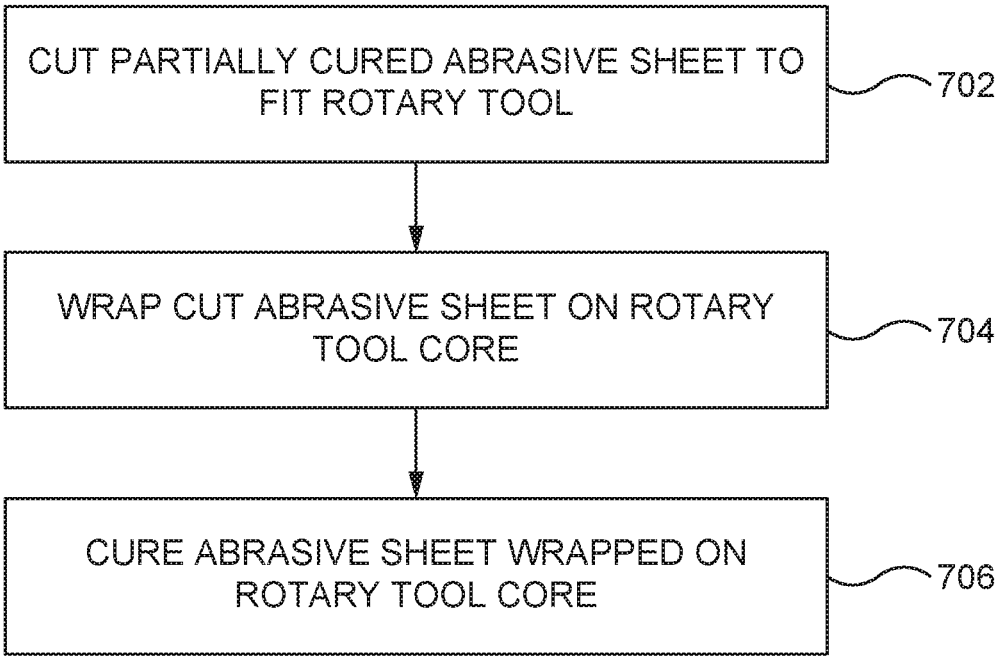
FIG. 10 is a flowchart illustrating example techniques for manufacturing a rotary tool with an epoxy abrasive sheet.

FIG. 10 is a flowchart illustrating example techniques for manufacturing a rotary tool with an epoxy abrasive sheet. First, an abrasive sheet including a partially-cured expoxy is cut to fit an abrasive surface of a rotary tool (702). Then the cut sheet is wrapped and adhered to a core of the rotary tool (704). Once the abrasive is in place on the core of the rotary tool, the epoxy of the abrasive material is further cured to increase the hardness and durability of the abrasive material (706).

In some particular examples, the abrasive material may include a plurality of ceramic abrasive agglomerates dispersed in an epoxy resin as previously described. In the same or different examples, the sheet of abrasive material may include the abrasive material deposited on a polymeric film with a primer layer between the abrasive composite layer and the polymeric film. The polymeric film itself may be positioned over a compliant layer, such as a foam, with an adhesive securing the polymeric film to the complaint layer. The combined abrasive material coating, polymeric material and complaint material may then be applied to the core of rotary tool in order to form the shape of abrasive surface on rotary tool in accordance with the techniques of FIG. 10.

The operation will be further described with regard to the following detailed examples. These examples are offered to further illustrate the various specific and preferred examples and techniques. It should be understood, however, that many variations and modifications may be made while remaining within the scope.

Listing of Embodiments

1. An abrasive rotary tool comprising:

a tool shank defining an axis of rotation for the rotary tool; and a flexible planar section positioned opposite the tool shank, wherein the flexible planar section forms a first abrasive external surface on a first side of the flexible planar section, the first side of the flexible planar section facing generally away from the tool shank, wherein the flexible planar section forms a second abrasive external surface on a second side of the flexible planar section, the second side of the flexible planar section facing in the general direction of the tool shank, wherein the flexible planar section facilitates abrading, with the first abrasive external surface, a first corner adjacent to a first side of a workpiece across multiple angles relative to the axis of rotation for the rotary tool through bending of the flexible planar section when the first abrasive external surface is applied to the first corner of the workpiece, and wherein the flexible planar section facilitates abrading, with the second abrasive external surface, a second corner adjacent to a second side of the workpiece, the second side of the workpiece opposing the first side of the workpiece, across multiple angles relative to the axis of rotation for the rotary tool through bending of the flexible planar section when the second abrasive external surface is applied to the second corner of the workpiece.

2. The abrasive rotary tool of embodiment 1, further comprising a cylindrical section attached to the tool shank, wherein the cylindrical section forms a third abrasive external surface surrounding the axis of rotation for the rotary tool, wherein the cylindrical section facilitates abrading an edge of the workpiece between the first side of the workpiece and the second side of the workpiece while operating of the abrasive rotary tool from the tool shank, and wherein the flexible planar section extends past the outer diameter of the cylindrical section relative to the axis of rotation for the rotary tool.

3. The abrasive rotary tool of embodiment 2, wherein the third abrasive external surface of cylindrical section provides at least two portions with different abrasive grain sizes from one another.

4. The abrasive rotary tool of embodiment 2 or embodiment 3, wherein the flexible planar section is a first flexible planar section, the abrasive rotary tool further comprising a second flexible planar section positioned between the tool shank and the cylindrical section, wherein the second flexible planar section extends past the outer diameter of the cylindrical section relative to the axis of rotation for the rotary tool, wherein the second flexible planar section forms a fourth abrasive external surface on a first side of the second flexible planar section, the first side of the second flexible planar section facing generally away from the tool shank, wherein the second flexible planar section forms a fifth abrasive external surface on a second side of the second flexible planar section, the second side of the second flexible planar section being adjacent to the cylindrical section and facing in the general direction of the tool shank, wherein the second flexible planar section facilitates abrading, with the fourth abrasive external surface, the first corner of the workpiece across multiple angles relative to the axis of rotation for the rotary tool through bending of the second flexible planar section when the fourth abrasive external surface is applied to the first corner of the workpiece, and wherein the second flexible planar section facilitates abrading, with the fifth abrasive external surface, the second corner of the workpiece across multiple angles relative to the axis of rotation for the rotary tool through bending of the second flexible planar section when the fifth abrasive external surface is applied to the second corner of the workpiece.

5. The abrasive rotary tool of embodiment 4, wherein the first abrasive external surface and the fourth abrasive external surface each provide larger abrasive grain sizes than each of the second abrasive external surface and the fifth abrasive external surface.

6. The abrasive rotary tool of embodiment 5, wherein the third abrasive external surface of cylindrical section provides at least two portions with different abrasive grain sizes from one another.

7. The abrasive rotary tool of any of embodiment 2-6, further comprising an elastically compressible layer backing the third abrasive external surface of cylindrical section.

8. The abrasive rotary tool of any of embodiment 2-7, wherein at least one of the first abrasive external surface and the second abrasive external surface includes an abrasive coating.

9. The abrasive rotary tool of any of the preceding embodiments, wherein the abrasive rotary tool is configured to surface finish a material selected from a group consisting of:

glass;

sapphire; and ceramics.

10. The abrasive rotary tool of any of the preceding embodiments, wherein at least one of the first abrasive external surface and the second abrasive external surface includes an abrasive film.

11. The abrasive rotary tool of any of the preceding embodiments, wherein at least one of the first abrasive external surface and the second abrasive external surface includes an abrasive secured to a substrate of the tool with an epoxy.

12. The abrasive rotary tool of any of the preceding embodiments, wherein the abrasive of at least one of the first abrasive external surface and the second abrasive external surface provides an abrasive grain size of less than 20 micrometers.

13. The abrasive rotary tool of any of the preceding embodiments, wherein the abrasive of at least one of the first abrasive external surface and the second abrasive external surface provides an abrasive grain size of between about 10 micrometers and about 1 micrometer.

14. The abrasive rotary tool of any of the preceding embodiments, wherein the abrasive of at least one of the first abrasive external surface and the second abrasive external surface provides an abrasive grain size of about 2 micrometers.

15. The abrasive rotary tool of any of the preceding embodiments, wherein the abrasive of at least one of the first abrasive external surface and the second abrasive external surface includes a resin-bonded diamond abrasive.

16. The abrasive rotary tool of any of the preceding embodiments, wherein the abrasive of at least one of the first abrasive external surface and the second abrasive external surface provides a diamond agglomerate.

17. The abrasive rotary tool of embodiment 16, wherein a volume ratio of diamond agglomerates to a resin binder within the abrasive is greater than 3 to 2.

18. The abrasive rotary tool of embodiment 16 or embodiment 17, wherein the average size of the diamond agglomerate is at least about 5 times the average size of the abrasive particles.

19. The abrasive rotary tool of any of the preceding embodiments, wherein the abrasive of at least one of the first abrasive external surface and the second abrasive external surface includes a Trizact patterned abrasive.

20. The abrasive rotary tool of any of the preceding embodiments, wherein the abrasive of at least one of the first abrasive external surface and the second abrasive external surface comprises:

a resin;

a plurality of ceramic abrasive agglomerate dispersed in the resin, the ceramic abrasive agglomerate comprising individual abrasive particles dispersed in a porous ceramic matrix, wherein at least a portion of the porous ceramic matrix comprises glassy ceramic material; and metal particles dispersed in the resin.

21. The abrasive rotary tool of any of the preceding embodiments, wherein the first corner of the workpiece and the second corner of the workpiece are formed by a hole in the workpiece extending from the first side to the second side.

22. An assembly comprising:

a CNC machine comprising computer controlled a rotary tool holder and a workpiece platform;

a workpiece representing partially-finished a cover glass for an electronic device secured to the workpiece platform, the cover glass forming at least one hole; and an abrasive rotary tool according to any of any of the preceding embodiments.

23. A method of abrading a surface of a hole in a partially-finished cover glass for an electronic device, the method comprising:

securing an abrasive rotary tool according to any of embodiments 1-21 within a rotary tool holder of a CNC machine; and operating the CNC machine to abrade the surface of the hole in the cover glass mounted to a workpiece platform of the CNC machine.

Examples

Materials

| Materials | |
|---|---|
| Abbreviation or Trade Name | Description |
| MCD1.5 | A 1.5 micron monocrystalline diamond, available from Diamond Innovations, Worthington, Ohio. |
| MCD2 | A 2 micron monocrystalline diamond, available from Diamond Innovations, Worthington, Ohio. |

* Particle size is the mean measured by conventional laser light scattering.

Test Methods and Preparation Procedures

Coverglass Production Test-1

A partially-finished coverglass following a scribing operation to form perimeter edges interior features edges, including holes was provided. The partially-finished coverglass was edge ground using a CNC machine to form the desired size and shape. Following the grinding step, the edges were polished to provide a suitable surface finish.

Coverglass Production Test-2

A partially-finished coverglass following a scribing operation to form perimeter edges interior features edges, including holes was provided. The partially-finished coverglass was edge ground using a CNC machine to form the desired size and shape. The edge ground coverglass was then abraded using the CNC machine to improve the surface finish of the ground edges. Following the abrading step, the edges were polished to provide a suitable surface finish.

Table 1 provides a comparison of Coverglass Production Test-1 and Coverglass Production Test-2.

| Process Step | Test-1 cycle time (seconds) | Test-2 cycle time (seconds) | Ra (nm) | Rz (nm) |
|---|---|---|---|---|
| Scribe and break glass | | | — | — |
| Edge grinding glass to size and shape | NA | NA | 551 | 6581 |
| Polish edges without abrading | 240 | — | 22 | 2286 |
| Abrade ground edge | — | 25 | 99 | 1390 |
| Polish edges after abrading | — | 60 | 19 | 103 |
| Total time | 240 seconds | 85 seconds | — | — |

Abrasive Effectiveness Test

A partially-finished coverglass following a scribing and rough grinding operation was provided. The cover glass material is Gorilla™ glass 3 from Corning™. The partially-finished coverglass was edge ground using a CNC machine to form the desired size and shape. The edge ground coverglass was then abraded using a CNC machine and a cylindrical abrasive tool to improve the surface finish of the ground edges. The surface finish of different diamond abrasive compositions was compared to evaluate the effectiveness of different abrasive compositions.

Table 2 provides a comparison of the different abrasive compositions evaluated using the Abrasive Effectiveness Test.

| Sample | Abrasive Diamond Size | Agglomerate Particle Size | Ra (nm) | Material Removed (in 10 min) |
|---|---|---|---|---|
| A | MCD1.5 | 30 μm | 100 | 5 mg |
| B | MCD2 | 30 μm | 175 | 16 mg |
| C | MCD2 | 20 μm | 95 | 15 mg |

As shown in Table 2, Sample C provided a much higher level of material removal than Sample A, which had a smaller abrasive size, and about the same level of material removal as Sample B. However, Sample B had high surface finish roughness compared to Sample A and Sample C. According to these results Sample C provides nearly the surface finish quality of Sample A while maintaining nearly the material removal speed of Sample B.

Sample C has a relatively high abrasive size relative to the agglomerate size. In particular, the ratio of abrasive size to agglomerate size for Sample C is 10 to 1. In other examples, a ratio of abrasive size to agglomerate size of no greater than 15 to 1, of no greater than 12.5 to 1, of no greater than 10 to 1, but no less than about 3 to 1, no less and may be likewise particularly useful for edge grinding coverglass.

Various examples of this disclosure have been described. These and other examples are within the scope of the following claims.

What is claimed is:

1. An abrasive rotary tool comprising:

a tool shank defining an axis of rotation for the rotary tool; and a flexible planar section positioned opposite the tool shank, wherein the flexible planar section forms a first abrasive external surface on a first side of the flexible planar section, the first side of the flexible planar section facing generally away from the tool shank, wherein the flexible planar section forms a second abrasive external surface on a second side of the flexible planar section, the second side of the flexible planar section facing in the general direction of the tool shank, wherein the flexible planar section includes a set of non-overlapping, flexible flaps that include the abrasive external surfaces, wherein the flexible planar section facilitates abrading, with the first abrasive external surface, a first corner adjacent to a first side of a workpiece across multiple angles relative to the axis of rotation for the rotary tool through bending of the flexible planar section when the first abrasive external surface is applied to the first corner of the workpiece, and wherein the flexible planar section facilitates abrading, with the second abrasive external surface, a second corner adjacent to a second side of the workpiece, the second side of the workpiece opposing the first side of the workpiece, across multiple angles relative to the axis of rotation for the rotary tool through bending of the flexible planar section when the second abrasive external surface is applied to the second corner of the workpiece;

further comprising a cylindrical section attached to the tool shank, wherein the cylindrical section forms a third abrasive external surface surrounding the axis of rotation for the rotary tool, wherein the cylindrical section facilitates abrading an edge of the workpiece between the first side of the workpiece and the second side of the workpiece while operating of the abrasive rotary tool from the tool shank, and wherein the flexible planar section extends past the outer diameter of the cylindrical section relative to the axis of rotation for the rotary tool.

2. The abrasive rotary tool of claim 1, wherein the third abrasive external surface of cylindrical section provides at least two portions with different abrasive grain sizes from one another.

3. The abrasive rotary tool of claim 1, wherein the flexible planar section is a first flexible planar section, the abrasive rotary tool further comprising a second flexible planar section positioned between the tool shank and the cylindrical section, wherein the second flexible planar section extends past the outer diameter of the cylindrical section relative to the axis of rotation for the rotary tool, wherein the second flexible planar section forms a fourth abrasive external surface on a first side of the second flexible planar section, the first side of the second flexible planar section facing generally away from the tool shank, wherein the second flexible planar section forms a fifth abrasive external surface on a second side of the second flexible planar section, the second side of the second flexible planar section being adjacent to the cylindrical section and facing in the general direction of the tool shank, wherein the second flexible planar section facilitates abrading, with the fourth abrasive external surface, the first corner of the workpiece across multiple angles relative to the axis of rotation for the rotary tool through bending of the second flexible planar section when the fourth abrasive external surface is applied to the first corner of the workpiece, and wherein the second flexible planar section facilitates abrading, with the fifth abrasive external surface, the second corner of the workpiece across multiple angles relative to the axis of rotation for the rotary tool through bending of the second flexible planar section when the fifth abrasive external surface is applied to the second corner of the workpiece.

4. The abrasive rotary tool of claim 3, wherein the first abrasive external surface and the fourth abrasive external surface each provide larger abrasive grain sizes than each of the second abrasive external surface and the fifth abrasive external surface.

5. The abrasive rotary tool of claim 4, wherein the third abrasive external surface of cylindrical section provides at least two portions with different abrasive grain sizes from one another.

6. The abrasive rotary tool of claim 1, further comprising an elastically compressible layer backing the third abrasive external surface of cylindrical section.

7. The abrasive rotary tool of claim 1, wherein at least one of the first abrasive external surface and the second abrasive external surface includes an abrasive coating.

8. The abrasive rotary tool of claim 1, wherein at least one of the first abrasive external surface and the second abrasive external surface includes an abrasive film.

9. The abrasive rotary tool of claim 1, wherein at least one of the first abrasive external surface and the second abrasive external surface includes an abrasive secured to a substrate of the tool with an epoxy.

10. The abrasive rotary tool of claim 1, wherein the abrasive of at least one of the first abrasive external surface and the second abrasive external surface provides an abrasive grain size of less than 20 micrometers.

11. The abrasive rotary tool of claim 1, wherein the abrasive of at least one of the first abrasive external surface and the second abrasive external surface provides an abrasive grain size of between about 10 micrometers and about 1 micrometer.

12. The abrasive rotary tool of claim 1, wherein the abrasive of at least one of the first abrasive external surface and the second abrasive external surface provides an abrasive grain size of about 2 micrometers.

13. The abrasive rotary tool of claim 1, wherein the abrasive of at least one of the first abrasive external surface and the second abrasive external surface includes a resin-bonded diamond abrasive.

14. The abrasive rotary tool of claim 1, wherein the abrasive of at least one of the first abrasive external surface and the second abrasive external surface provides a diamond agglomerate.

15. The abrasive rotary tool of claim 1, wherein the abrasive of at least one of the first abrasive external surface and the second abrasive external surface includes a TRIZACT patterned abrasive.

16. The abrasive rotary tool of claim 1, wherein the abrasive of at least one of the first abrasive external surface and the second abrasive external surface comprises:

a resin;

a plurality of ceramic abrasive agglomerate dispersed in the resin, the ceramic abrasive agglomerate comprising individual abrasive particles dispersed in a porous ceramic matrix, wherein at least a portion of the porous ceramic matrix comprises glassy ceramic material; and metal particles dispersed in the resin.

17. An assembly comprising:

a CNC machine comprising computer controlled a rotary tool holder and a workpiece platform;

a workpiece representing partially-finished a cover glass for an electronic device secured to the workpiece platform, the cover glass forming at least one hole; and an abrasive rotary tool according to claim 1.

18. A method of abrading a surface of a hole in a partially-finished cover glass for an electronic device, the method comprising:

securing an abrasive rotary tool according to claim 1 within a rotary tool holder of a CNC machine; and operating the CNC machine to abrade the surface of the hole in the cover glass mounted to a workpiece platform of the CNC machine.

* * * * *